US005988125A

United States Patent [19]

Hara et al.

[11] Patent Number: 5,988,125

[45] Date of Patent: Nov. 23, 1999

[54] VARIABLE VALVE ACTUATION APPARATUS FOR ENGINE

[75] Inventors: Seinosuke Hara; Yoshihiko Yamada; Keisuke Takeda; Tsutomu Hibi; Akira Ohnuki; Shunichi Aoyama; Makoto Nakamura; Shinichi Takemura; Tetsuro Goto, all of Kanagawa; Katsuya Moteki, Tokyo; Tsuneyasu Nohara, Kanagawa, all of Japan

[73] Assignees: Unisia Jecs Corporation, Atsugi; Nissan Motor Co., Ltd., Yokohama, both of Japan

[21] Appl. No.: 09/130,490

[22] Filed: Aug. 7, 1998

[30] Foreign Application Priority Data

Aug. 7, 1997 [JP] Japan ..... 9-212831
Aug. 8, 1997 [JP] Japan ..... 9-214221

[51] Int. Cl.[6] ..... F01L 13/00

[52] U.S. Cl. ..... 123/90.16; 123/90.17; 123/90.6

[58] Field of Search ..... 123/90.15, 90.16, 123/90.17, 90.22, 90.23, 90.39, 90.6; 74/567, 568 R

[56] References Cited

U.S. PATENT DOCUMENTS

| | | | |
|---|---|---|---|
| 4,397,270 | 8/1983 | Aoyama | 123/90.16 |
| 4,572,118 | 2/1986 | Baguena | 123/90.16 |
| 5,148,783 | 9/1992 | Shinkai et al. | 123/90.16 |
| 5,431,132 | 7/1995 | Kreuter et al. | 123/90.16 |
| 5,586,527 | 12/1996 | Kreuter | 123/90.15 |
| 5,592,906 | 1/1997 | Kreuter et al. | 123/90.16 |
| 5,732,669 | 3/1998 | Fischer et al. | 123/90.16 |
| 5,787,849 | 8/1998 | Mitchell | 123/90.17 |
| 5,899,180 | 5/1999 | Fischer | 123/90.16 |

FOREIGN PATENT DOCUMENTS 55-137305 10/1980 Japan .

OTHER PUBLICATIONS

R.J. Pierik et al., "A Low–Friction Variable–Valve–Actuation Device, Part I: Mechanism Description and Friction Measurements", pp. 81–87, (1997).

*Primary Examiner*—Weilun Lo
*Attorney, Agent, or Firm*—Foley & Lardner

[57] ABSTRACT

A variable valve actuation (VVA) apparatus comprises an eccentric rotary (ER) cam fixed to a driving shaft for rotation therewith, a pivotal valve operating (VO) cam, a rocker arm having a first arm and a second arm, a control rod having an eccentric control cam, and a crank arm. The eccentric control cam supports the rocker arm for pivotal motion. The crank arm interconnects the ER cam and the first arm of the rocker arm. A link interconnects the second arm of the rocker arm and the VO cam.

30 Claims, 25 Drawing Sheets

VARIABLE VALVE ACTUATION APPARATUS FOR ENGINE

FIELD OF THE INVENTION

The present invention relates to a variable valve actuation (VVA) apparatus for an engine having a plurality of cylinder valves.

BACKGROUND OF THE INVENTION

U.S. Pat. No. 4,397,270 (=JP-A 55-137305) discloses a variable valve timing and lift system. It includes a driving shaft, a control rod with axially spaced eccentric cams, and a pivot structure. The pivot structure supports valve operating (VO) cams for pivotal motion above valve lifters of cylinder valves. Springs are mounted for the VO cams, respectively. Each of the springs biases one of the corresponding rocker cams toward its rest position where the associated cylinder valve closes. Rocker arms operate the VO cams, respectively. The eccentric cams, which are in rotary unison with the control rod, bear the rocker arms, respectively. An axis of each of the eccentric cams serves as the center of drive of the corresponding one of the rocker arms. Cams fixed to the driving shaft operate the rocker arms, respectively. An electronic control module (ECM) is provided. Sensors on the engine send information on engine speed, engine load, vehicle speed, and coolant temperature to the ECM. At a predetermined swithover point, the ECM sends a signal to an actuator for the control rod. As the actuator turns the control rod, the eccentricity of each of the eccentric cams with respect to an axis of the control shaft changes. This alters the position of pivot center of the rocker arms relative to the position of pivot center of the VO cams. This causes variation in valve timing and lift of each of the cylinder valves.

According to this known system, the driving shaft is not mounted above the cylinder valves. This arrangement has a potential problem that the considerable modification of the conventional overhead camshaft engine is required to install the driving shaft. Besides, the pivot structure and driving shaft requires a considerable space to install.

the driving arrangement in which the rocker arms press the VO cams against the springs confines an allowable angle through which the VO cams can pivot within such a relatively narrow range as to ensure that the rocker arms will not disengage from the VO cams.

According to the driving arrangement, the springs maintain contact of the VO cams with the rocker arms. This contact cannot be maintained when the driving shaft rotates at high speed due to inertia of the springs. This causes the occurrence of undesired motion of the cylinder valves.

An object of the present invention is to provide a VVA apparatus, which may be mounted to the conventional overhead camshaft engines without any considerable modification of the cylinder heads.

SUMMARY OF THE INVENTION

The VVA apparatus according to the present invention features driving contact between a rocker arm and a VO cam without any bias of a spring. This driving contact ensures a motion connection, without any loss, between the rocker arm and the VO cam over the whole modes of engine operation including high-speed operation of a driving shaft.

The VVA apparatus according to the present invention comprises:

a driving shaft;

an eccentric rotary (ER) cam fixed to said driving shaft for rotation therewith;

a pivotal valve operating (VO) cam;

a rocker arm having a first arm and a second arm, said second arm of said rocker arm being linked with said VO cam;

a control rod having an eccentric control cam, said eccentric control cam supporting said rocker arm for pivotal motion; and a crank arm interconnecting said ER cam and said first arm of said rocker arm.

DESCRIPTION OF THE PREFERRED EMBODIMENTS

Figure 1:
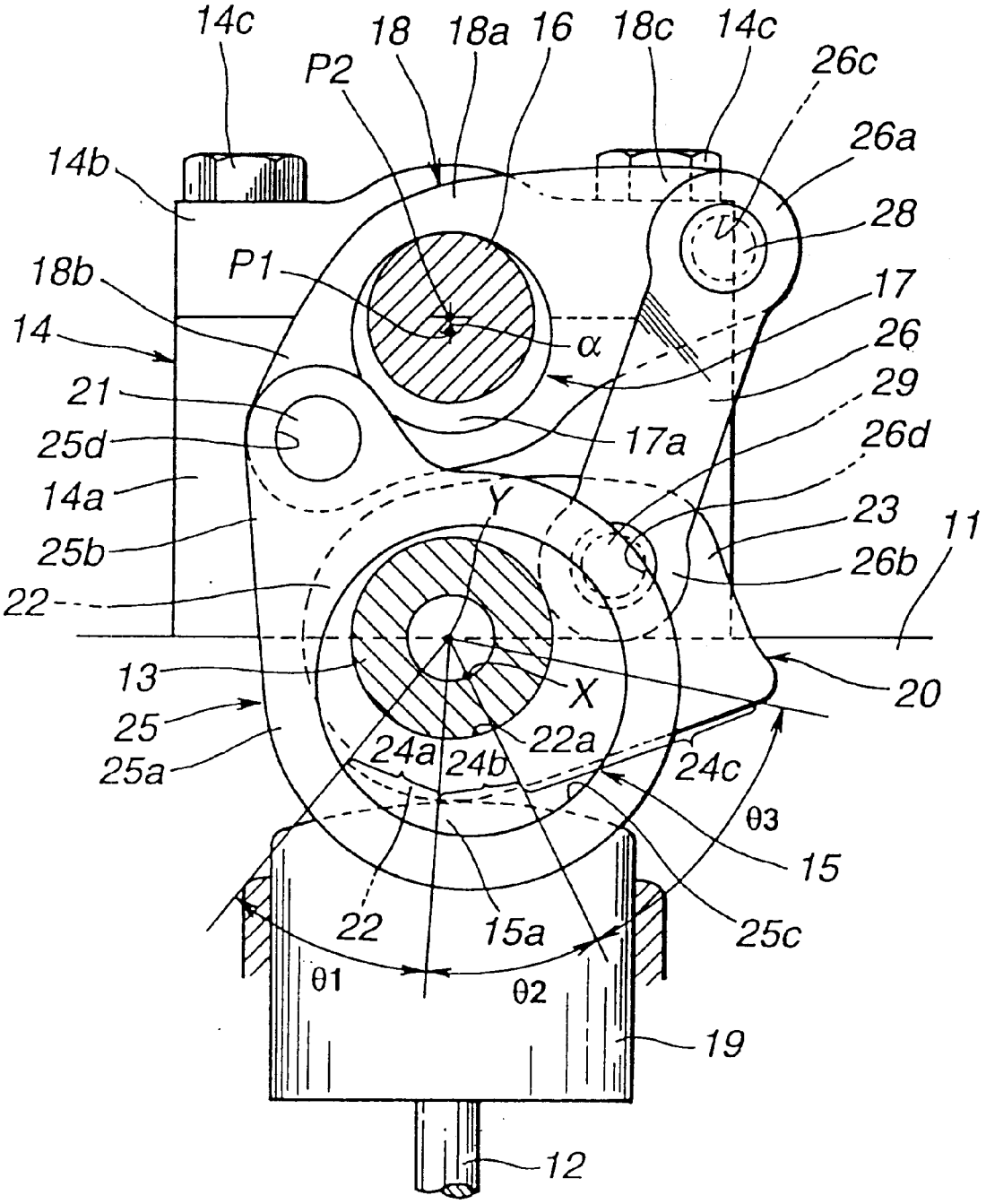
FIG. 1 is a cross section taken through the line 1—1 in FIG. 2.

Referring to the accompanying drawings, like reference numerals and characters are used throughout all of the Figures to denote like or similar parts or portions for the sake of simplicity of description.

Figure 2:
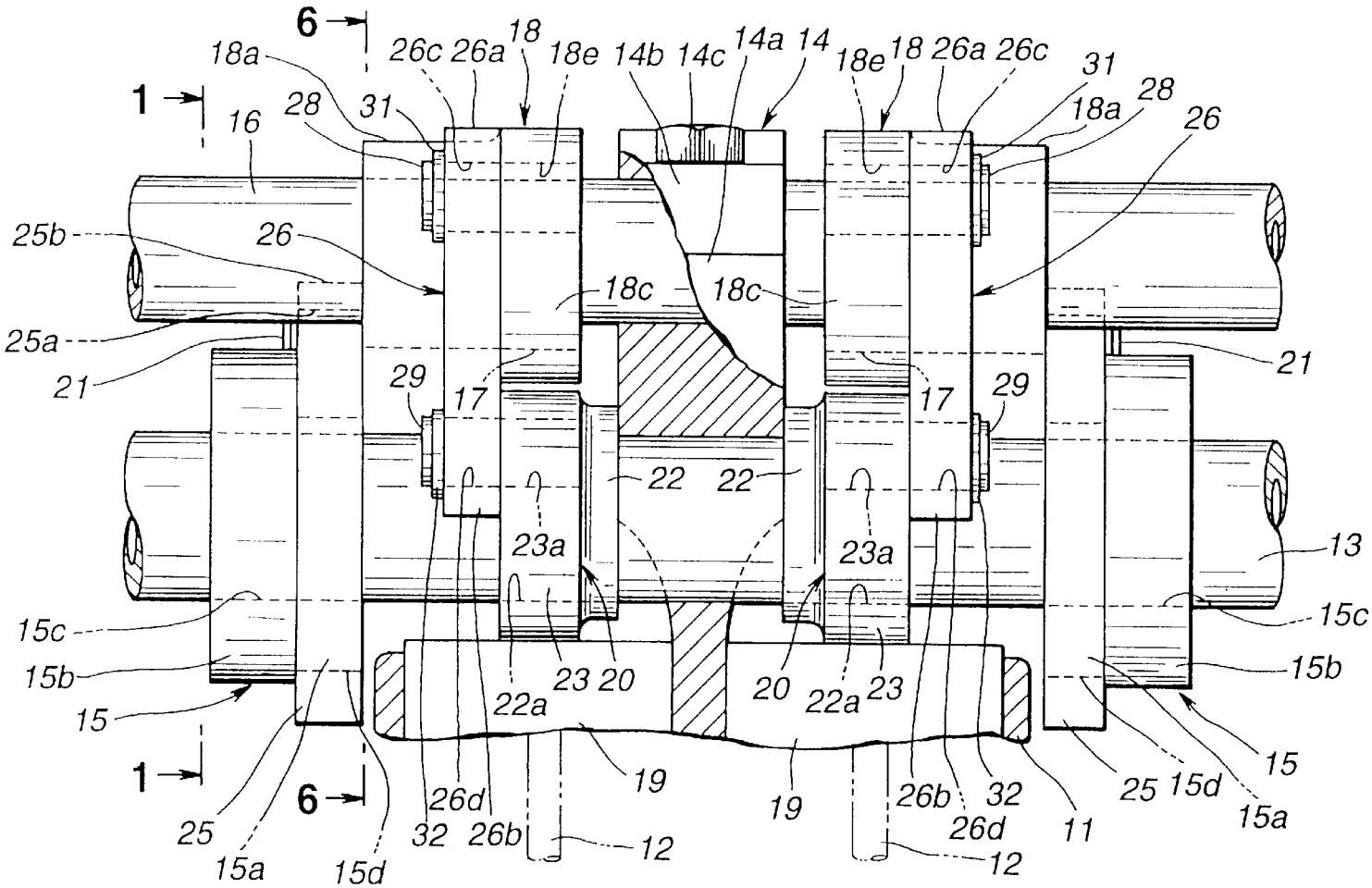
FIG. 2 is a side view, partly broken away, illustrating a variable valve actuation (VVA) apparatus as assembled.
Figure 3:
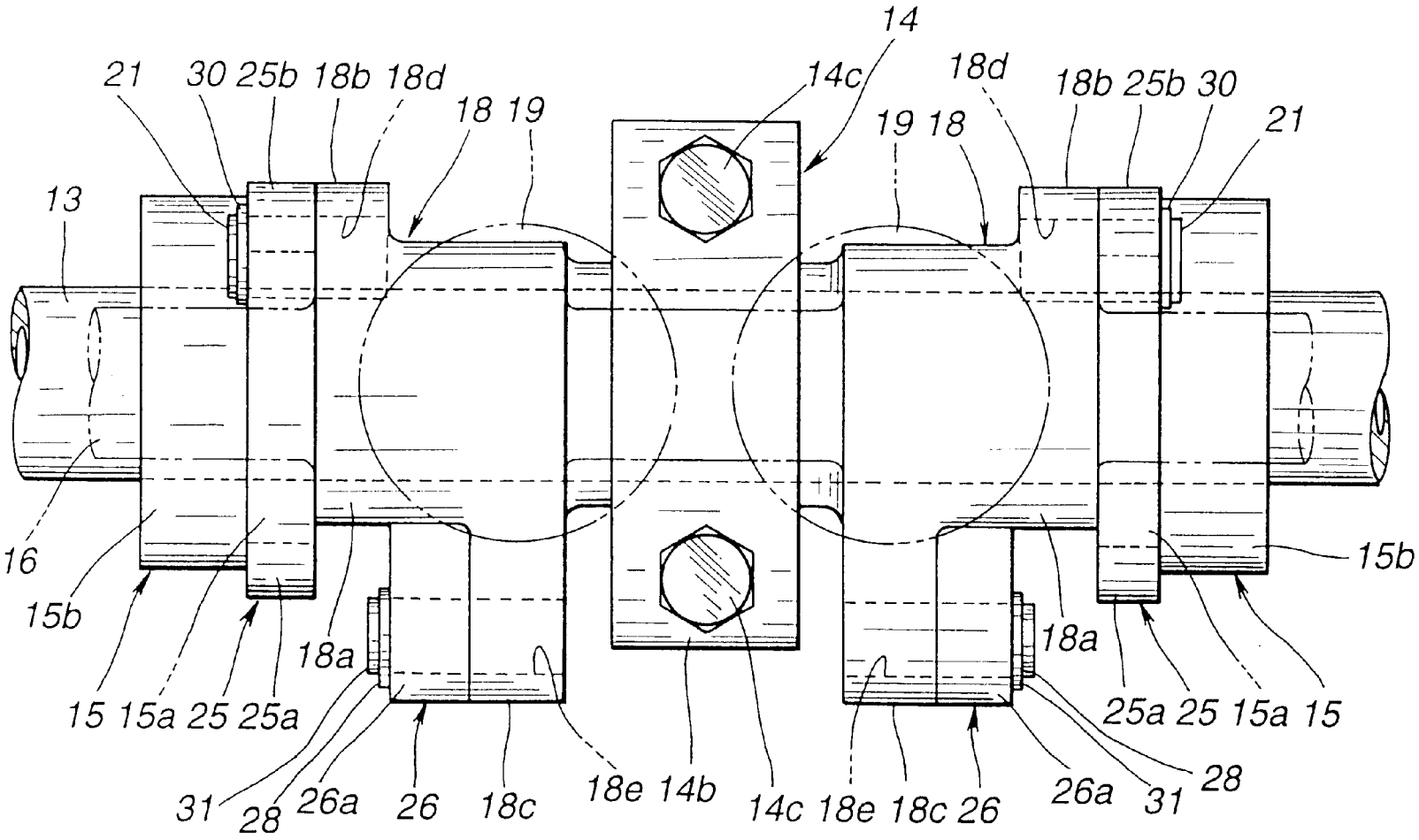
FIG. 3 is a top plan view of the VVA apparatus.

Referring to FIGS. 1 to 3, the reference numeral 11 designates a cylinder head of an overhead camshaft internal combustion engine. The engine has four cylinder valves per cylinder. They include two intake valves 12, 12 and two exhaust valves (not shown). Valve guides, not shown, of the cylinder head 11 support the intake valves 12, 12, respectively.

A variable valve actuation (VVA) apparatus implementing the present invention includes at least one cylinder valve that opens when a cylinder performs an intake phase or an exhaust phase. The apparatus is described hereinafter in detail taking the intake valves 12, 12 as an example of the cylinder valves. It is to be noted that the cylinder valve may take the form of an exhaust valve if desired.

Cam bearings, only one being shown at 14, on the cylinder head 11 support a driving shaft 13, which is hollowed (see FIG. 3), and a control rod 16. Viewing in FIG. 3, the driving shaft 13 is disposed above and in operative association with valve lifters 19, 19 for the intake valves 12, 12. The cam bearing 14 includes a main bracket 14*a* that holds the driving shaft 13 on the cylinder head 11. A subordinate bracket 14*b* holds the control rod 16 on the main bracket 14*a* in spaced relationship with the driving shaft 13. A pair of fasteners in the form of bolts 14*c* (see FIG. 1) fixedly secures the brackets 14*a* and 14*b* to the cylinder head 11. A crankshaft (not shown) provides drive force from the engine to the driving shaft 13 via pulleys and a timing chain. The driving shaft 13 extends from a front end of the cylinder head 11 to a rear end thereof.

Figure 4:
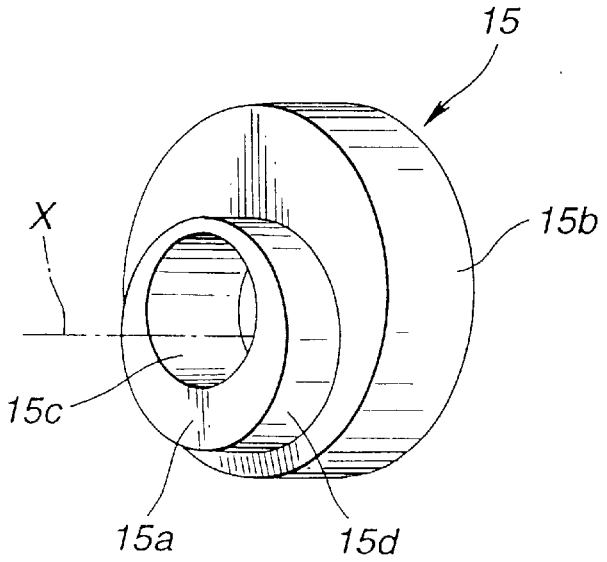
FIG. 4 is a perspective view of an eccentric circular cam serving as a crank cam.

The driving shaft 13 has two axially spaced eccentric rotary (ER) cams 15, 15 per cylinder. The ER cams 15, 15, which may be named driving cams, are fixed to the driving shaft 13. As best seen in FIG. 2, two ER cams 15, 15 are provided for the two intake valves 12, 12, respectively. They are axially spaced from each other and out of interference with valve lifters 19, 19 for the intake valves 12, 12. Referring also to FIG. 4, each ER cam 15 has a circular cam section 15*a* and a circular flange section 15*b*, and is formed with a through hole 15*c*. The driving shaft 13 is press fitted into the through holes 15*c* of the ER cams 15. The circular cam section 15*a* of each ER cam 15 has a cylindrical outer peripheral surface 15*d* and an axis or center X that is offset from an axis Y, namely a shaft axis, of rotation of the driving shaft 13. In this embodiment, the ER cams 15, 15 for each cylinder have centers X offset in the same eccentric direction and amount from the axis Y of the driving shaft 13. However, they may have different eccentric directions and/or amounts with respect to the shaft axis Y, if desired.

As shown in FIGS. 2 and 3, the ER cams 15, 15 are axially spaced in directions away from the cam bearing 14 to allow layout of valve operating (VO) cams 20, 20 for contact with the valve lifters 19, 19. Viewing in FIG. 2, the ER cams 15, 15 on the left and right sides of the cam bearing 14 are not identical in configuration. They are in mirror image relationship with respect to a hypothetical vertical plane bisecting the cam bearing 14. Specifically, the ER cams 15, 15 that are in mirror image relationship have the flange sections 15*b*, 15*b* on the remotest sides of the circular cam sections 15*a*, 15*a* with respect to the cam bearing 14.

Viewing in FIG. 2, the VO cams 20, 20 on the left and right sides are not identical in configuration. They are in mirror image relationship with respect to the hypothetical bisecting vertical plane. The VO cams 20, 20 that are in mirror image relationship are formed with holes 22*a*, 22*a* and have hubs 22, 22 projecting toward each other for abutting contact with the opposite faces of the cam bearing 14. In this embodiment, the VO cams 20, 20 that are in mirror image relationship have the same profile as shown in FIG. 1 although they may have different profiles, if desired.

The driving shaft 13 extends through the holes 22*a*, 22*a* of the VO cams 20, 20 and the holes 15*c*, 15*c* of the ER cams 15, 15. Rotation of the driving shaft 13 about the axis Y will apply no torque or the least torque to the VO cams 20, 20 although it causes the ER cams 15, 15 to move as a unit with the driving shaft 13.

As best seen in FIG. 1, each VO cam 20 includes a cam lobe 23 extending outwardly from the associated hub 22 and has a peripheral cam surface in driving contact with the associated valve lifter 19. The peripheral cam surface consists of a base circle portion 24*a* that defines a part of a base circle about the shaft axis Y, a ramp portion 24*b* that defines a ramp, and a lift portion 24*c* that defines a lift of the cam lobe 23.

The control rod 16 has a control rod axis P2. It has axially spaced eccentric control cams 17, 17, each in the form of a sleeve having an axis P1 and a thickened portion 17*a*. Viewing in FIG. 2, the control cams 17, 17 are disposed on the left and right sides of the cam bearing 14, respectively, and fixed to the control rod 16 for unitary rotation about the control rod axis P2. Viewing in FIG. 1, the axis P1 of each control cam 17 is offset from the control rod axis P2 in a direction toward the driving shaft 13 by an amount $\alpha$ (alpha). The control cams 17, 17 that are disposed on the left and right sides of the cam bearing 14 support rocker arms 18, 18, respectively, for pivotal motion about the axis P1.

Referring to FIGS. 2 and 3, the rocker arms 18, 18 have sleeves 18*a*, 18*a* that receive the controls cams 17, 17, respectively. The sleeves 18*a*, 18*a* can rotate relative to the control cams 17, 17 about the axis P1.

Viewing in FIGS. 2 and 3, the rocker arms 18, 18 on the left and right sides of the cam bearing 14 are not identical in configuration, but in mirror image relationship with respect to the hypothetical vertical plane bisecting the cam bearing 14. Specifically, the two rocker arms 18, 18 that are in mirror image relationship have first arms 18*b*, 18*b*, and second arms 18*c*, 18*c*. The first arms 18*b*, 18*b* extend in a radial outward direction from and define the remotest ends of the sleeves 18*a*, 18*a* of the left and right rocker arms 18, 18 from the cam bearing 14. The second arms 18*c*, 18*c* extend in another radial outward direction from and define the nearest ends of the sleeves 18*a*, 18*a* of the left and right rocker arms 18, 18 to the cam bearing 14.

The first arms 18*b*, 18*b* are arranged in driving cooperation with the adjacent ER cams 15, 15, respectively, while the second arms 18*c*, 18*c* are arranged in driving cooperation with the adjacent VO cams 20, 20, respectively. As best seen in FIG. 2, the second arms 18*c*, 18*c* are vertically aligned with the adjacent VO cams 20, 20, respectively.

The first arms 18*b*, 18*b* and the adjacent ER cams 15, 15 are interconnected by crank arms 25, 25, respectively, while the second arms 18*c*, 18*c* and the adjacent VO cams 20, 20 are interconnected by links 26, 26.

As best seen in FIG. 1, each crank arm 25 includes an annular base portion 25*a* and an integral radial extension 25*b*. The annular base portion 25*a* is formed with a cylindrical bore 25*c*, which receives the circular cam section 15*a* of the ER cam 15. Specifically, the annular base portion 25*a* has a cylindrical inner wall that defines the bore 25*c*. This cylindrical inner wall is opposed to the cylindrical outer peripheral surface 15*d* for sliding cooperation therewith to allow movement of the circular cam 15*a* relative to the annular base portion 25*a*. The radial extension 25*b* includes a hole 25*d*, receiving a pin 21 that is received in a hole 18*d* drilled through the first arm 18*b* of the adjacent rocker arm 18. In this embodiment, at one end portion, the pin 21 is press fitted into the hole 18*d* for providing immobility of the pin 21 relative to the first arm 18*b*. At the other end portion, it is fitted into the hole 25*d* for allowing rotation of the radial extension 25*b* relative to the pin 21. A snap ring 30 engages the pin 21 to prevent removal of the radical extension 25*b* from the pin 21. If desired, a pin 21 may be fixed to the radial extension 25*b*. In this case, the pin 21 is fitted into the hole 18*d* of the first arm 18*b* for allowing rotation of the first arm 18*b* relative to the pin 21. In both of the cases, the pin 21 must be strong enough to keep the holes 18*d* and 25*d* in alignment with each other.

Each link 26 is a straight link with circular ends 26*a* and 26*b*. The circular end 26*a* is formed with a hole 26*c* receiving a pin 28 that is press fitted into a hole 18*e* drilled through the second arm 18*c* *a*of the associated rocker arm 18. As shown in FIG. 2, a snap ring 31 engages the pin 28 to prevent removal of the link 26 from the pin 28. The other circular end 26*b* is formed with a hole 26*d* receiving a pin 29 that is press fitted into a hole 23*a* (see FIG. 2) drilled through the cam lobe 23 of the associated VO cam 20. A snap ring 32 engages the pin 29 to prevent removal of the link 26 from the pin 29. In this case, the pin 28 is fixed relative to the second arm 18*c* of the rocker arm 18 and the pin 29 is fixed relative to the VO cam 20, while the line 26 is allowed to rotate relative to the pins 28 and 29. If desired, pins 28 and 29 may be fixed relative to the link 26. In this case, the pin 28 is fitted into the hole 18*e* of the second arm 18*c* for allowing rotation of the second arm 18*c* relative to the pin 28. Further, the other pin 29 is fitted into the hole 23*a* of the VO cam 20 for allowing rotation of the VO cam 20 relative to the pin 29. In both of these cases, the pin 28 must be strong enough to keep the holes 26*c* and 18*e* in alignment with each other, and the pin 29 must be strong enough to keep the holes 26*d* and 23*a* in alignment with each other.

An actuator in the form of an electromagnetic actuator, not shown, is drivingly coupled with the control rod 16. An electronic control module (ECM) or a controller, not shown, is provided. Sensors on the engine send information on engine speed, engine load, vehicle speed, and coolant temperature to the ECM. At a predetermined switchover point, the ECM sends a signal to the actuator for the control rod 16.

Figure 5:
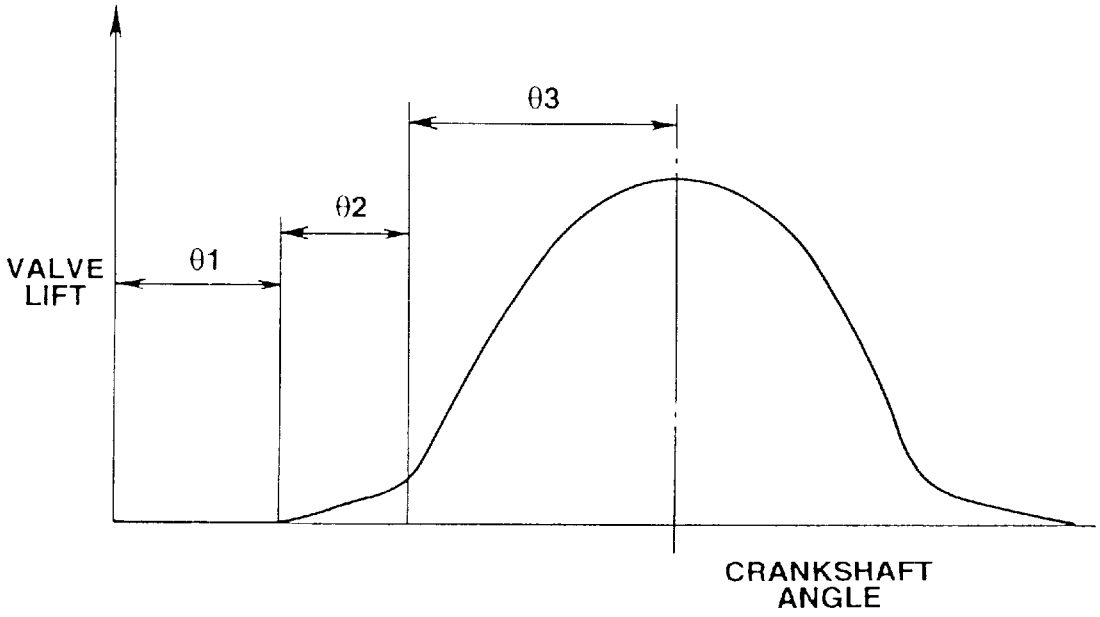
FIG. 5 graphs a valve lift diagram.

Turning back to FIG. 1, the base circle, ramp, and lift portions 24*a*, 24*b*, and 24*c* of each VO cam 20 extend about the axis Y of the driving shaft 13 through angles $\theta 1$, $\theta 2$, and $\theta 3$, respectively, if expressed in terms of crankshaft angle. The valve lift diagram of FIG. 5 illustrates the contour of the peripheral cam surface of the VO cam 20. As the discussion proceeds, it will be appreciated that a pivot angle through which each VO cam 20 can pivot may be increased to a satisfactory level because the VVA apparatus allows the use of a rocker arm having an increased rocker ratio. The rocker ratio is a ratio of distance between the center of pin 28 and the axis P1 to distance between the axis P1 and the center of pin 21. This sufficiently increased pivot angle allows the use of a ramp long enough to lower speed at which the VO cam 20 comes into collision with the valve lifter, thereby making contribution to reduction of noise owing to this interference.

Figure 6B:
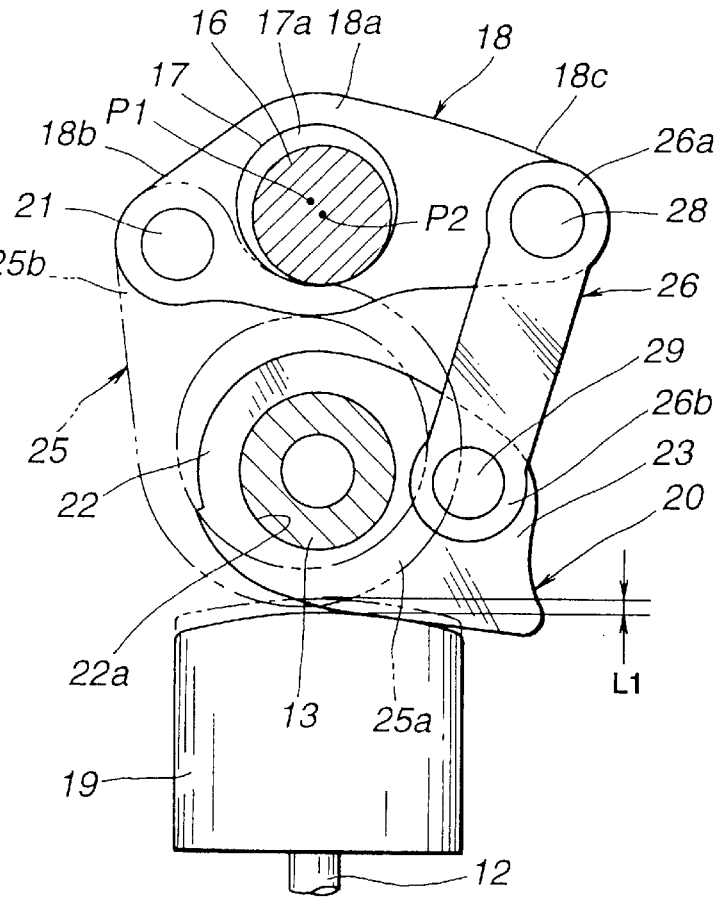
FIG. 6(B) is a similar view to FIG. 6(A) but illustrates position of parts for the first engine operation mode to lift the associated valve lifter by a maximum lift amount $L_1$.
Figure 6A:
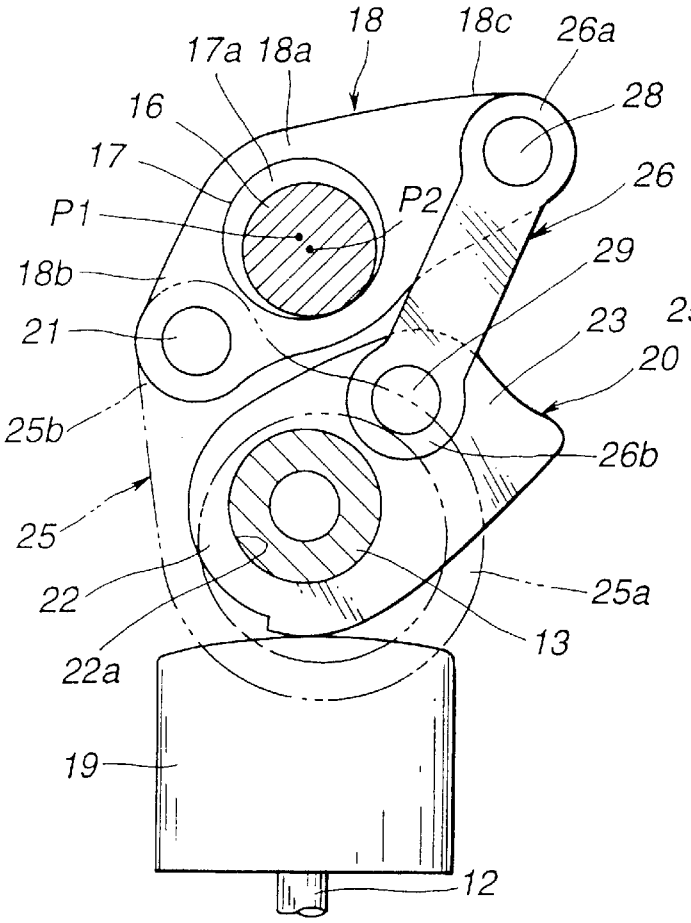
FIG. 6(A) is a cross section taken through the line 6—6 in FIG. 2, illustrating position of parts, with a control rod at a zero degree position for a first engine operation mode, to allow the associated valve lifter in its rest position.
Figure 7B:
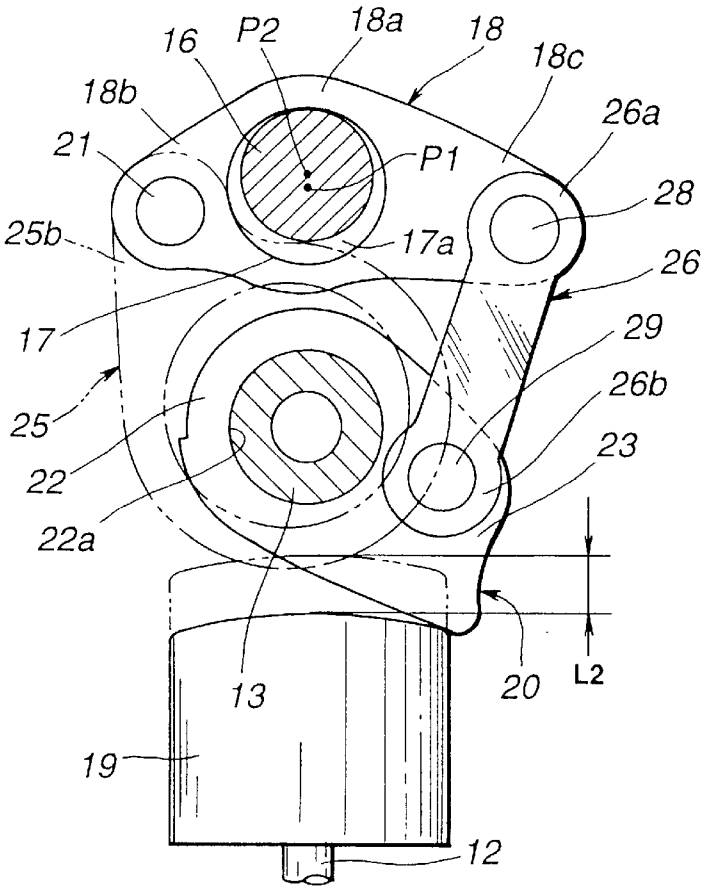
FIG. 7(B) is a similar view to FIG. 6(B), illustrating position of parts, with the control rod at the rotated position for a second engine operation mode, to lift the associated valve lifter by an increased maximum lift amount $L_2$.
Figure 7A:
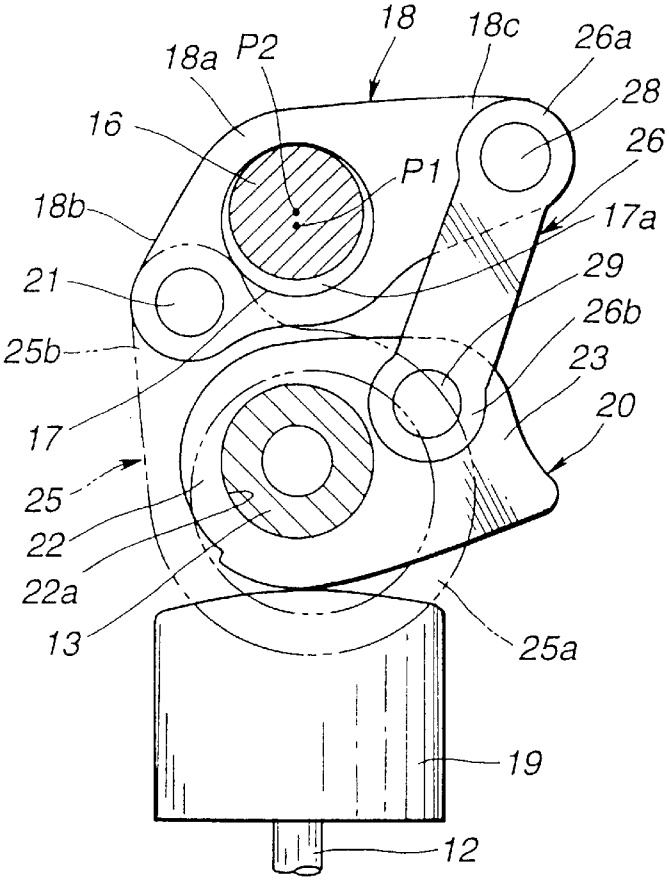
FIG. 7(A) is a similar view to FIG. 6(A), illustrating position of parts, with the control rod at a rotated position from the zero degree position for a second engine operation mode, to allow the associated valve lifter in its rest position.

In this embodiment, the actuator turns the control rod 16 between the position of FIG. 6A and the position of FIG. 7A. It is to be noted that the position of FIG. 7A is the same as the position of FIG. 1.

During a shift from the position of FIG. 7A to the position of 6A, the thickened portion 17*a* of each control cam 17 orbits counterclockwise about the axis P2 of the control rod 16 as the control rod 16 turns counterclockwise through a predetermined angle of, for example, 220 degrees. This orbit motion is allowed by clockwise rotation of the crank arm 25 relative to the ER cam 15. As a result of this shift, the direction of eccentricity of the axis P1 of each control cam 17 with respect to the axis P2 of the control rod 16 changes through the predetermined angle and the axis P1 of each control cam 17 displaces by a predetermined amount. This causes each rocker arm 18 to lift the associated pin 28 from the position of FIG. 7A to the position of FIG. 6A, causing the link 26 to rotate the VO cam 20 counterclockwise from the position of FIG. 7A to the position of FIG. 6A.

During a reverse shift from the position of FIG. 6A to the position of 7A, the thickened portion 17*a* orbits clockwise about the axis P2 as the control rod 16 turns clockwise through the predetermined angle of, for example, 220 degrees. This orbit motion if allowed by clockwise rotation of the crank arm 25 relative to the ER cam 15. This shift causes each rocker arm 18 to lower the associated pin 28 from the position of FIG. 6A to the position of FIG. 7A, causing the link 26 to rotate the VO cam 20 clockwise from the position of FIG. 6A to the position of FIG. 7A.

Figure 8:
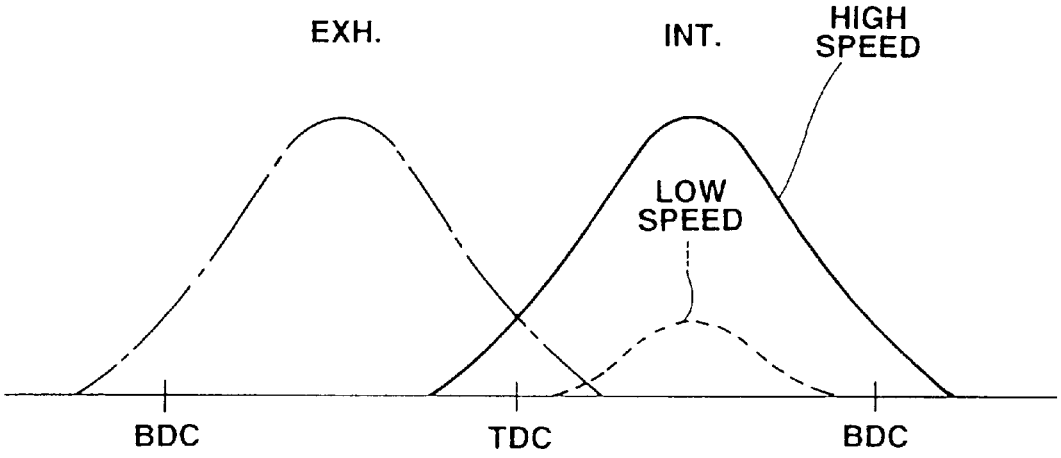
FIG. 8 graphs a valve lift diagram of a cylinder valve in the form of an intake valve to which the VVA apparatus is applied.
Figure 9:
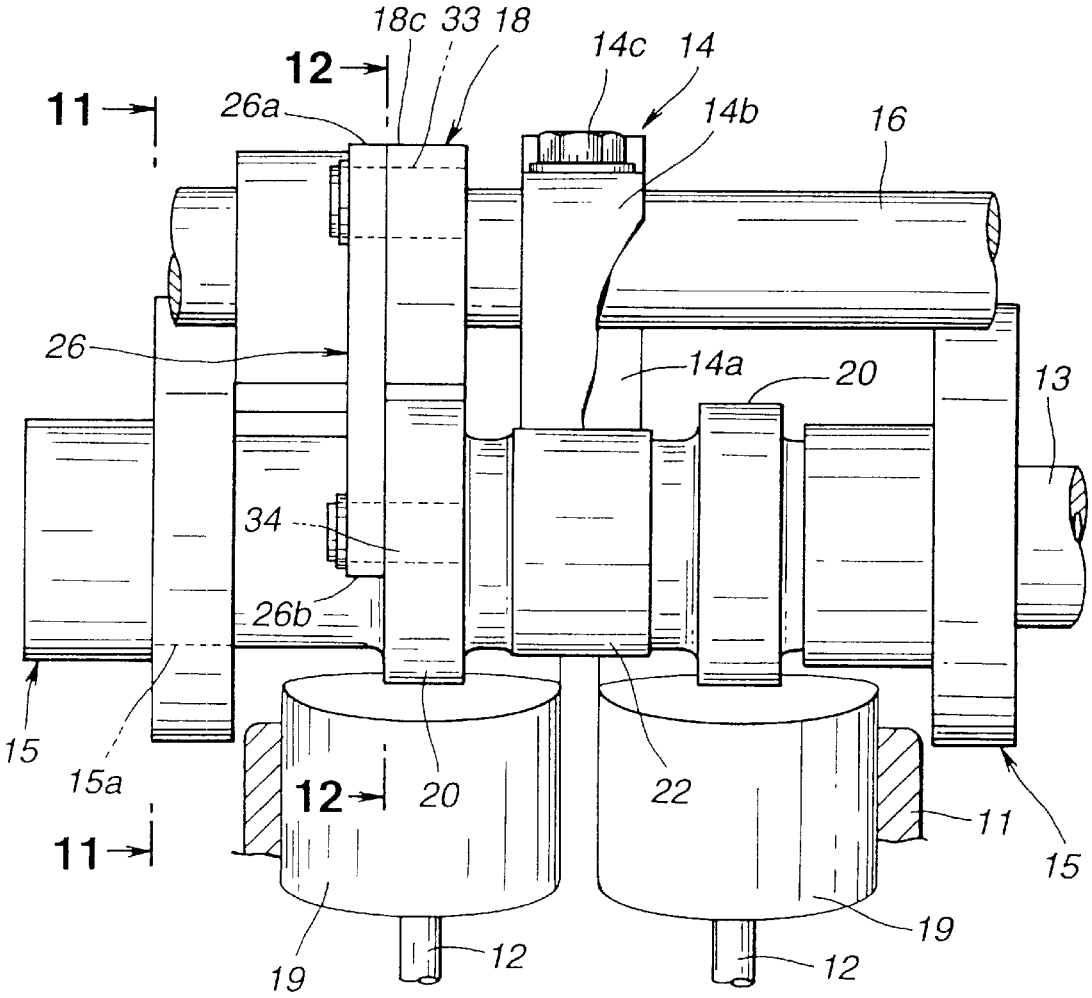
FIG. 9 is a side view of a second embodiment of a VVA apparatus according to the present invention.
Figure 10:
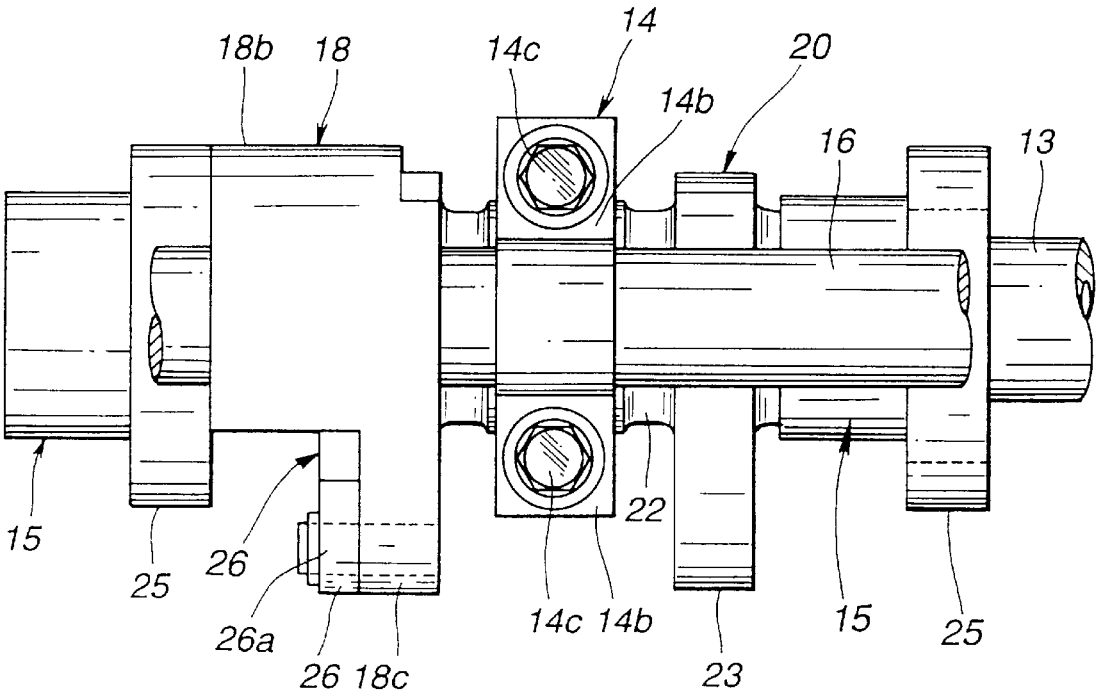
FIG. 10 is a top plan view of the second embodiment.
Figure 11:
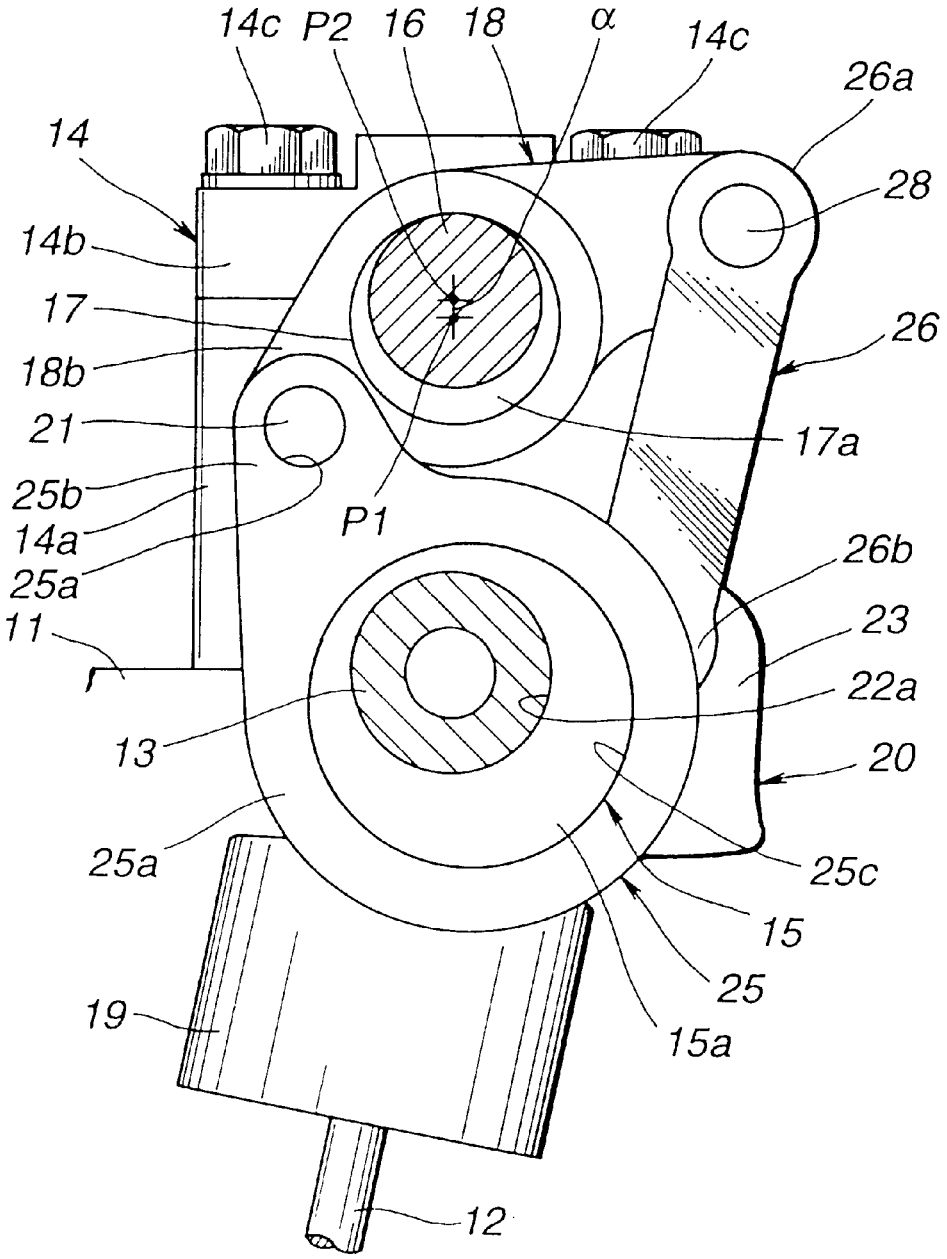
FIG. 11 is a cross section taken through the line 11—11 in FIG. 9.
Figure 12:
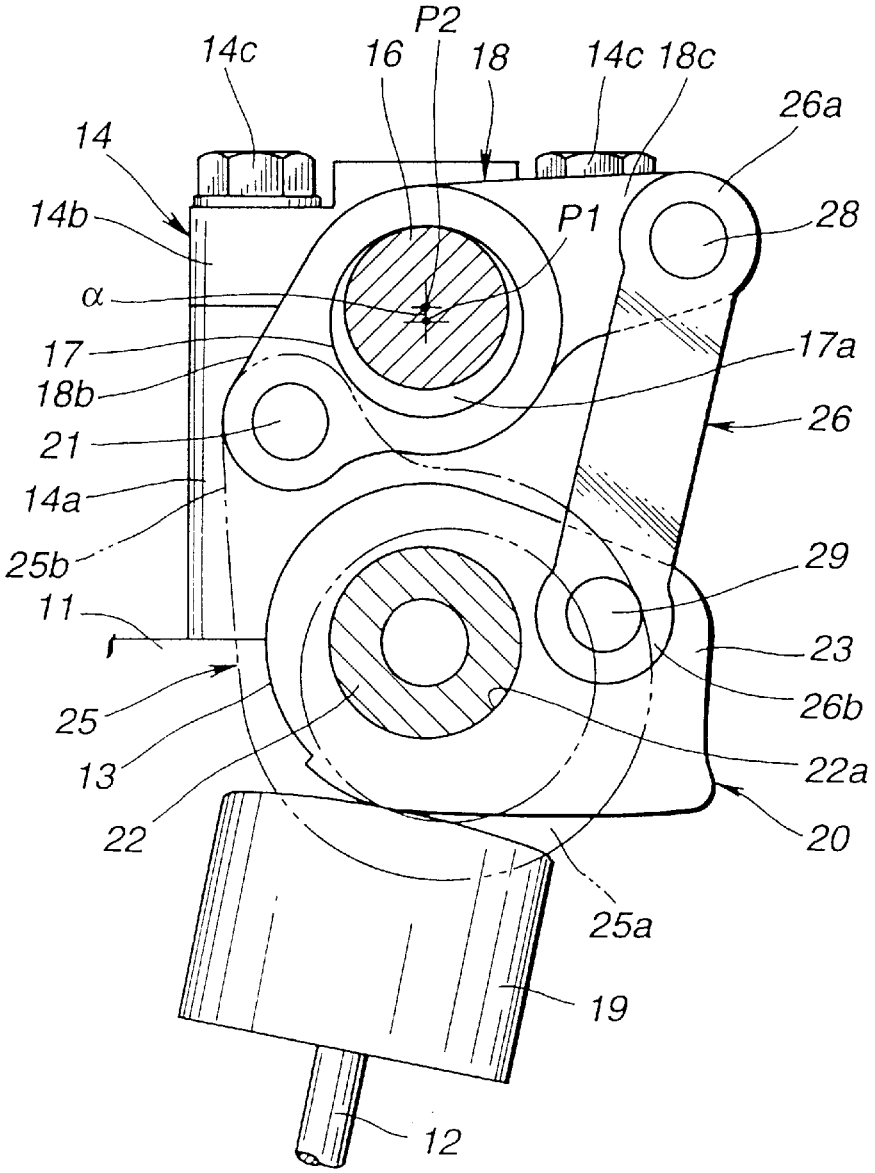
FIG. 12 is a cross section taken through the line 12—12 in FIG. 9.

Suppose the axis P1 takes the position of FIGS. 7A and 7B for the second engine operation mode. In this embodiment, the second engine operation mode represents engine operation at high speed with heavy load. In operation of the engine, rotation of the driving shaft 13 through 360 degrees causes the center X to orbit around the axis Y through 360 degrees. First half of each turn of this orbit motion of the center X causes the pin 21 to move from the position of FIG. 7A to the position of FIG. 7B. Second half following this first half causes the pin 21 to move from the position of FIG. 7B to the position of FIG. 7A. Thus, rotation of the driving shaft 13 is converted into reciprocal motion of the pin 21 between the position of FIG. 7A and the position of FIG. 7B. This reciprocal motion of the pin 21 is translated by the rocker arm 18, pin 28, link 26, and pin 29 into reciprocal pivotal motion of the VO cam 20 between the position of FIG. 7A and the position of FIG. 7B. This reciprocal pivotal motion of the VO cam 20 causes the valve lifter 19 to reciprocate between its closed position of FIG. 7A and its opened or lifted position of FIG. 7B by a lift amount L2. The fully drawn curve shown in FIG. 8 illustrates a valve lift diagram of each intake valve 12 under this condition. FIG. 8 also shows a valve lift diagram of the associated exhaust valve by one-dot chain line curve. From this two valve lift diagrams, it will be appreciated that the VVA apparatus gives a sufficiently long valve opening duration with high lift that is requested for the intake valves 12 during engine operation at high speed under heavy load. It is to be noted that the contour of the ramp and lift portions 24*b* and 24*c* of each VO cam 20 are brought into operative contact with the associated valve lifter 19 during the reciprocal pivotal motion.

Suppose now that the axis P1 takes the position of FIGS. 6A and 6B for the first engine operation mode. In this embodiment, the first engine operation mode represents engine operation at low speed with light load. In operation of the engine, rotation of the driving shaft 13 is converted into reciprocal motion of the pin 21 between the position of FIG. 6A and the position of FIG. 6B. This reciprocal motion of the pin 21 is translated by the rocker arm 18, pin 28, link 26, and pin 29 into reciprocal pivotal motion of the VO cam 20 between the position of FIG. 6A and the position of FIG. 6B. This reciprocal pivotal motion of the VO cam 20 causes the valve lifter 19 to reciprocate between its closed position of FIG. 6A and its opened or lifted position of FIG. 6B by a lift amount L1 that is less than the lift amount L2 (see FIG. 7B). The dotted line curve shown in FIG. 8 illustrates a valve lift diagram of each intake valve 12 under this condition. It will be appreciated that the VVA apparatus gives a short valve opening duration with low lift that is requested for the intake valves 12 to minimize valve overlap with the exhaust valve during engine operation at low speed under light load. It is to be noted that only a portion of the contour of the lift portion 24*c* of each VO cam 20 is brought into operative contact with the associated valve lifter 19 during the reciprocal pivotal motion.

From the preceding description of the first embodiment, it is appreciated that the driving shaft 13 supports not only the ER cams 15, but also the VO cams 20. This structure has made it possible to install the VVA apparatus within a laterally restrained space about the cylinder head.

With regard to the rocker arms 18 pivotally mounted above the driving shaft 13, the first arms 18*b* extend toward the cylinder head 11 (see FIG. 1), thus making contribution to reduction in overall size of VVA apparatus. This makes it easy to install the VVA apparatus on the engine.

Further modification of layout of the driving shaft 13 is not requested in installing the VVA apparatus. Thus, installation of the VVA apparatus has been simplified.

In installation of the VVA apparatus, the shaft axis Y about which the center X of ER cams 15 is to orbit must align with the pivot center of VO cams 20 for maintaining accuracy in valve timings over operation life of the engine. This alignment has been accomplished according to the first embodiment by employing the structure that the driving shaft 13 supports the ER cams 15 and VO cams 20.

With regard to the arrangement of ER cams 15, the ER cams 15 occupy spaces that are offset from and thus out of interference with the associated valve lifters 19. This arrangement has made it possible to use ER cams 15 each having increased overall radial size. Further, flexibility has improved in designing contour of the outer peripheral surfaces 15*a* of ER cams 15. Thus, it has been made possible to use an ER cam that has a cam width wide enough to reduce bearing stress, which the cam is subjected to, to a satisfactorily low level.

According to the embodiment, each of the ER cams 15 has its outer cylindrical peripheral surface 15*a* in bearing contact with the bore 25*c* defining cylindrical inner wall of the associated crank arm 25. This arrangement is effective to disperse the bearing stress, which the ER cam 15 is subjected to, thus suppressing occurrence of any local stress. This causes a considerable reduction in the rate of wear of the outer cylindrical peripheral surface 15*a*. This arrangement is easy to lubricate. The reduction in the bearing stress has expanded the range of materials, which ER cams 15 may be made of, to such an extent as to allow the use of a low cost material that is easy to machine.

Referring to FIG. 1, the VVA apparatus may be evaluated as a six-link mechanism. This mechanism consists of six links as follows:

First link interconnecting the axis Y and axis X,

Second link interconnecting the axis X and the center of pin 21,

Third link interconnecting the center of pin 21 and the center of pin 28, Fourth link interconnecting the center of pin 28 and the center of pin 29, Fifth link interconnecting the center of pin 29 and the axis Y, and Sixth link interconnecting the shaft axis Y and the axis P1.

It will be noted that third link between the pins 21 and 28 is a lever pivoted at the axis P1. With the same input displacement imparted to the pin 21, increasing the rocker ratio may increase output displacement of the pin 28. The rocker ratio is a ratio of distance between the pivot axis P1 and the center of the pin 28 to distance between the pivot axis P1 and the center of the pin 21. This ratio may be sufficiently increased without causing any motion transmitting loss because the link mechanism positively interconnects each of the crank arms 25 and the associated VO cam 20. Thus, it is no longer necessary to increase the eccentricity of each of the ER cams 15 for the purpose of obtaining a sufficiently long output displacement of the pin 28.

The links 26 interconnect the rocker arms 18 and the associated VO cams 20, respectively. This maintains the positive motion connection between the rocker arms 18 and VO cams 20 even if the rocker ratio of the rocker arms is increased. Thus, a sufficiently large pivot angle of the VO cams 20 is given by employing rocker arms 18 having sufficiently increased rocker ratio, allowing the use of VO cam with sufficiently long ramp duration (θ2). Use of sufficiently long ramp duration is effective to reduce speed at which the VO cam 20 collides with the valve lifter 19, resulting in noise reduction.

The rocker arm 18 is linked by the link 26, without any help of a return spring, with the VO cam 20, securing driving connection between them over relatively large angle through which the rocker arm 18 can rotate. Thus, the axis P1 can be moved by a sufficiently large amount to meet demand for increased amount of modification of valve timing.

The cam bearing 14, which is disposed between the two intake valves 12, 12 for the driving shaft 13, supports the control rod 16. Thus, any modification on the cylinder head of the conventional engine is needed in installing the VVA apparatus, thus minimizing any additional cost. The driving shaft 13 of the VVA apparatus is mounted in the place where a conventional camshaft was mounted, so that any modification on this part of the cylinder head is needed.

The rocker arms 18 are arranged above the driving shaft 13. Thus, any increase in height of the cylinder head is minimized.

The second embodiment is illustrated in FIGS. 9 to 12. This embodiment is substantially the same as the first embodiment. However, the former is different from the latter in that, per cylinder, VO cams 20, 20 are integrated so that they can pivot about a shaft axis Y of a driving shaft 13. Thus, what is required per cylinder to operate the integrated VO cams 20, 20 are an ER cam 15, a crank arm 25, a rocker arm 18, and a link 26.

The integrated VO cams 20, 20 have a hub 22 in common. Viewing in FIG. 9, the VO cam 20 on the right side of a cam bearing 14 is not provided with any link for cooperation with the rocker arm 18.

The common hub 22 is relatively long for interconnecting the axially spaced two VO cams 20, 20. This structure is advantageous in keeping the VO cams 20 in appropriate positions relative to the associated valve lifters 19, 19.

In this embodiment, cam lobes 23, 23 of the VO cams 20, 20 are identical in profile. However, two different cam lobes may be used, if desired. Suppose two different cam lobes provide different valve lifts. In this case, a desired swirl can be generated in the cylinder.

Figure 13:
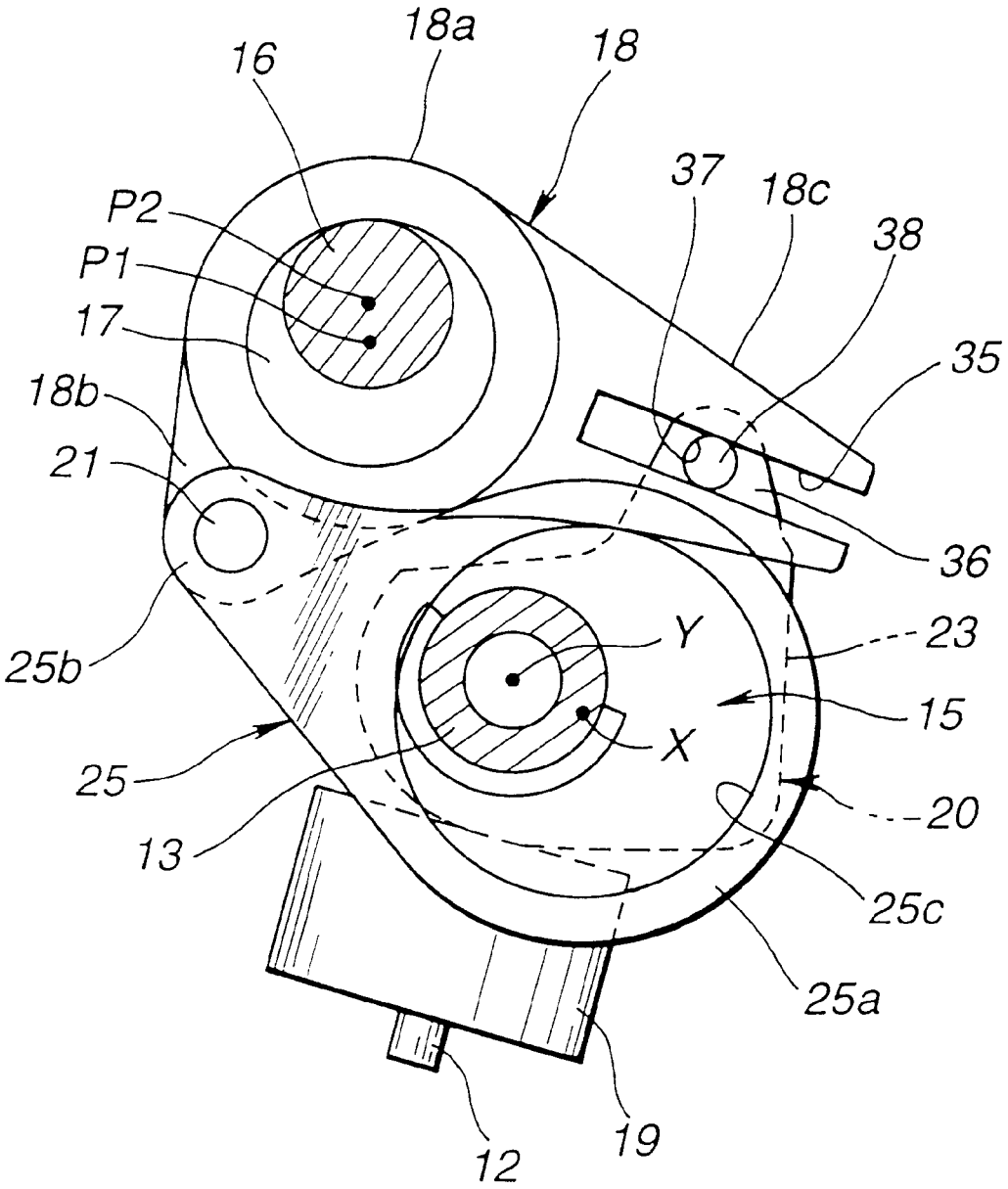
FIG. 13 is a similar view to FIG. 1, illustrating a third embodiment of a VVA apparatus according to the present invention.

The third embodiment is illustrated in FIG. 13. The third embodiment is substantially the same as the first embodiment except that an integral arm 36 of a VO cam 20 and a pin 38 and groove 35 connection have substituted for the link 26 and pins 28 and 29 (see FIG. 1).

In FIGS. 13, the arm 36 is in the form of a protrusion of a cam lobe 23 of the VO cam 20. Adjacent its leading end, the arm 36 is formed with a hole 37 that receives the pin 38. A rocker arm 18 of the third embodiment is different from its counter part of the first embodiment in that its second arm 18*c* has the groove 35 in the place of the hole 18*e* receiving the pin 28 (see FIG. 2). The groove 35 is cut inwardly toward an axis P1 about which the rocker arm 18 pivots. The pin 38 is received in the groove 35 to produce the pin and groove connection that ensures pivotal motion of the VO cam 20 in cooperation with pivotal motion of the rocker arm 18. The pin 37 can slide along the mutually facing walls of the groove 35 during pivotal motion of the rocker arm 18.

This third embodiment is advantageous in that the apparatus is stripped off the weight of the link 26 to reduce the inertia and scaled down considerably to provide a more compact arrangement.

Figure 14:
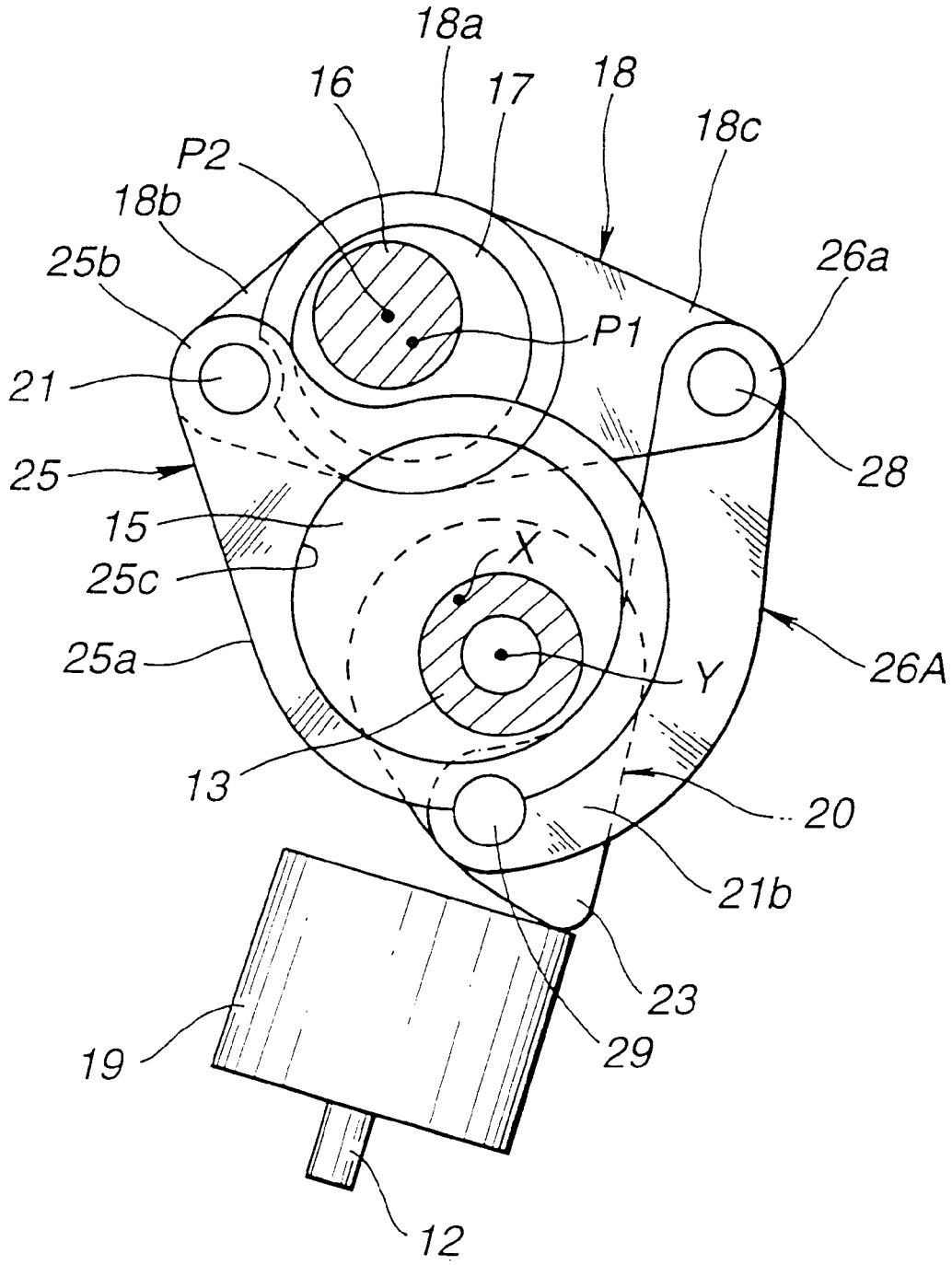
FIG. 14 is a similar view to FIG. 7(B), illustrating a fourth embodiment of a VVA apparatus according to the present invention.

FIG. 14 illustrates the fourth embodiment. This fourth embodiment is substantially the same as the first embodiment except the provision of a curved link 26A in the place of the link 26 that is straight. The link 26A is curved to avoid interference with a driving shaft 13.

Although, in the first and second embodiments, two intake valve per cylinder are used in explaining the invention. Alternatively, the present invention may be applied to two exhaust valves per cylinder. Further the present invention may be applied to both intake and exhaust valves. Further, the present invention may be applied to one cylinder valve, which may be an intake valve or an exhaust valve, per cylinder.

From the preceding description of the embodiments, it is appreciated that a train of the cam bearings 14 supports the control rod 16 and the driving shaft 13, which in turn supports the VO cams 20 controlling the intake valves 12. The present invention is not limited to this arrangement. The present invention encompasses a modification that a train of cam bearings supports the driving shaft and the control rod, while a stationary shaft supports the VO cams. In this case, the VO cams control first cylinder valves, such as intake valves, and the driving shaft has second VO cams controlling second cylinder valves, such as exhaust valves. In this modified arrangement, the control rod for the rocker arm may be supported over the second VO cams or over the first mentioned VO cams.

The modification is further described along with the fifth to seventh embodiments illustrated in FIGS. 15 to 27.

Figure 15:
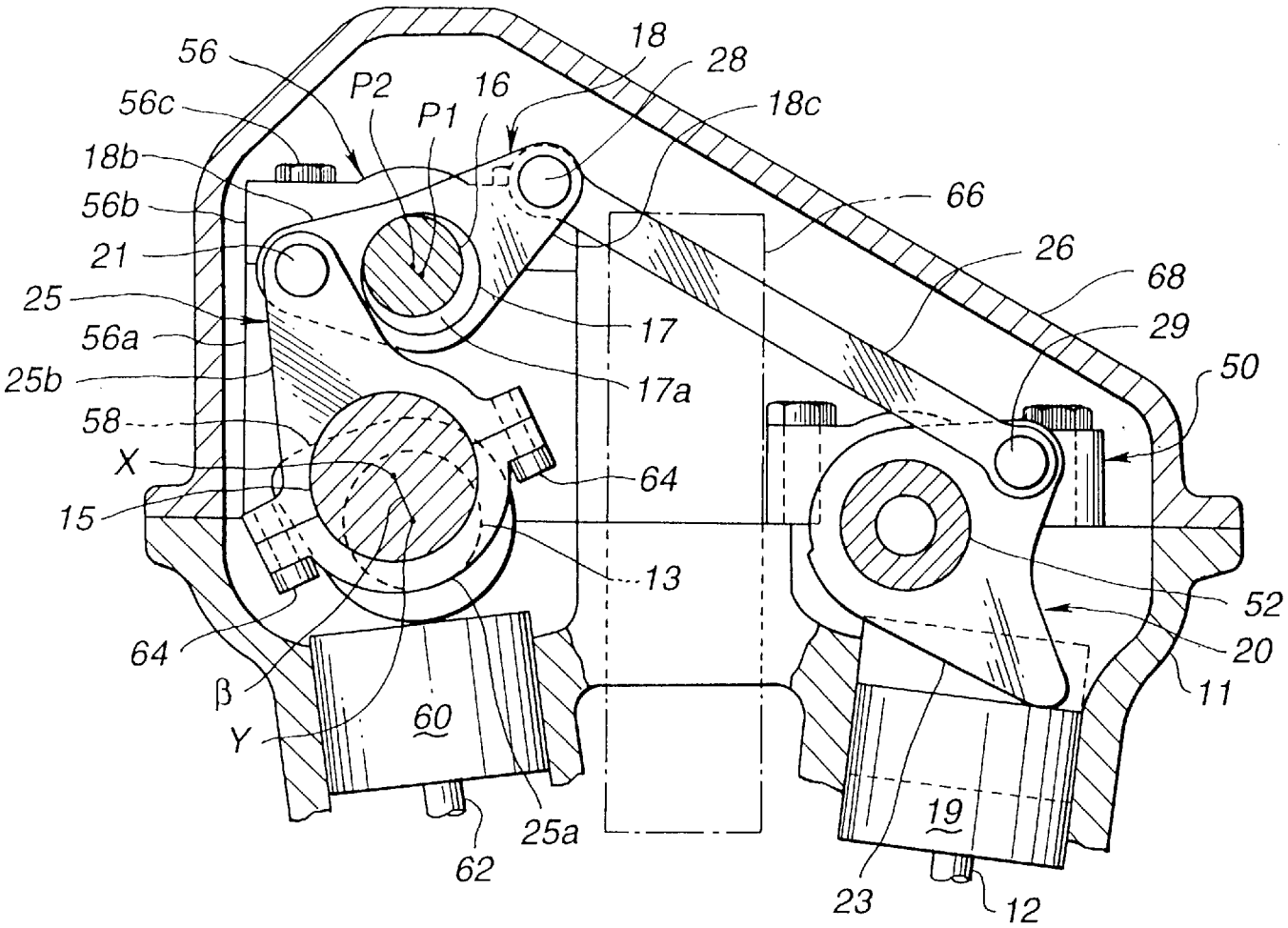
FIG. 15 is a cross section taken through the line 15—15 in FIG. 17, illustrating a fifth embodiment of a VVA apparatus according to the present invention.
Figure 16:
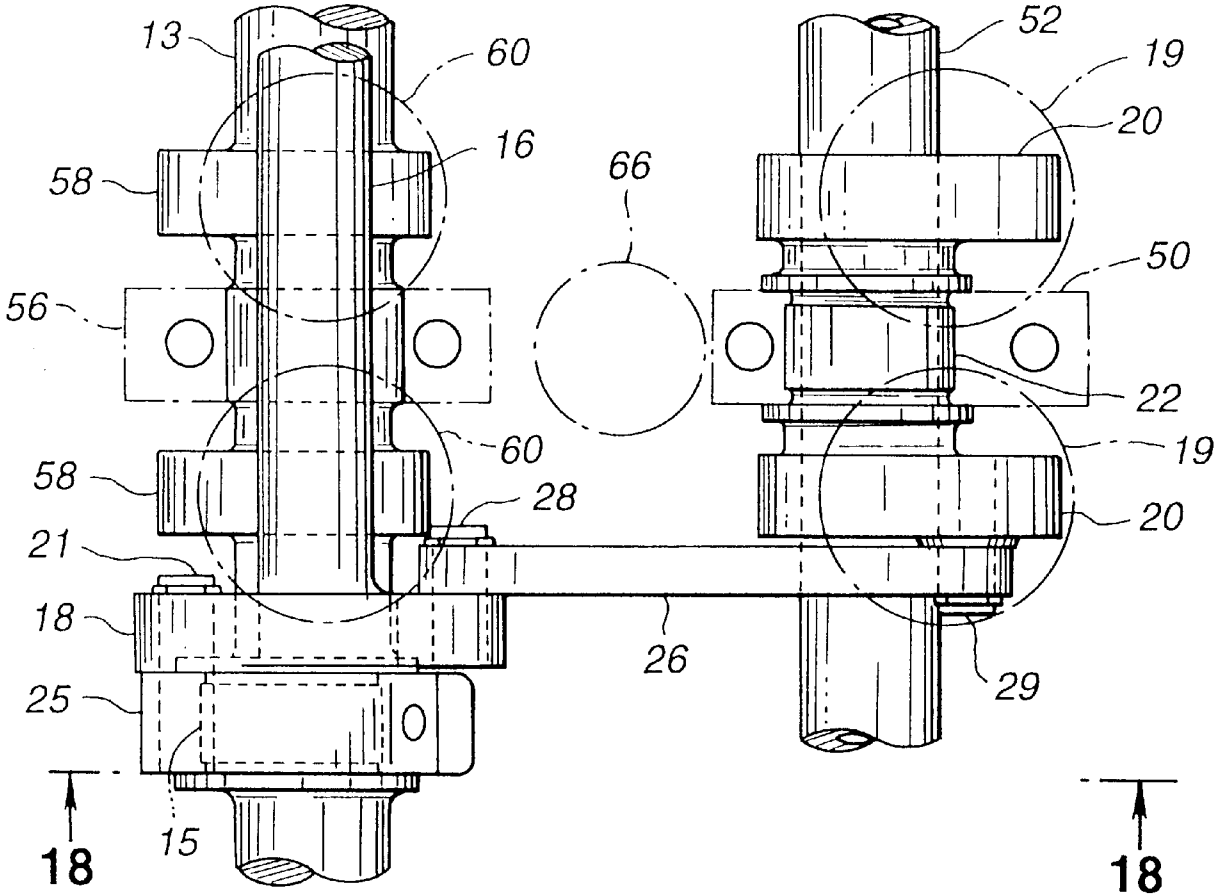
FIG. 16 is a fragmentary top plan view of the VVA apparatus shown in FIG. 15 with unnecessary parts removed.
Figure 17:
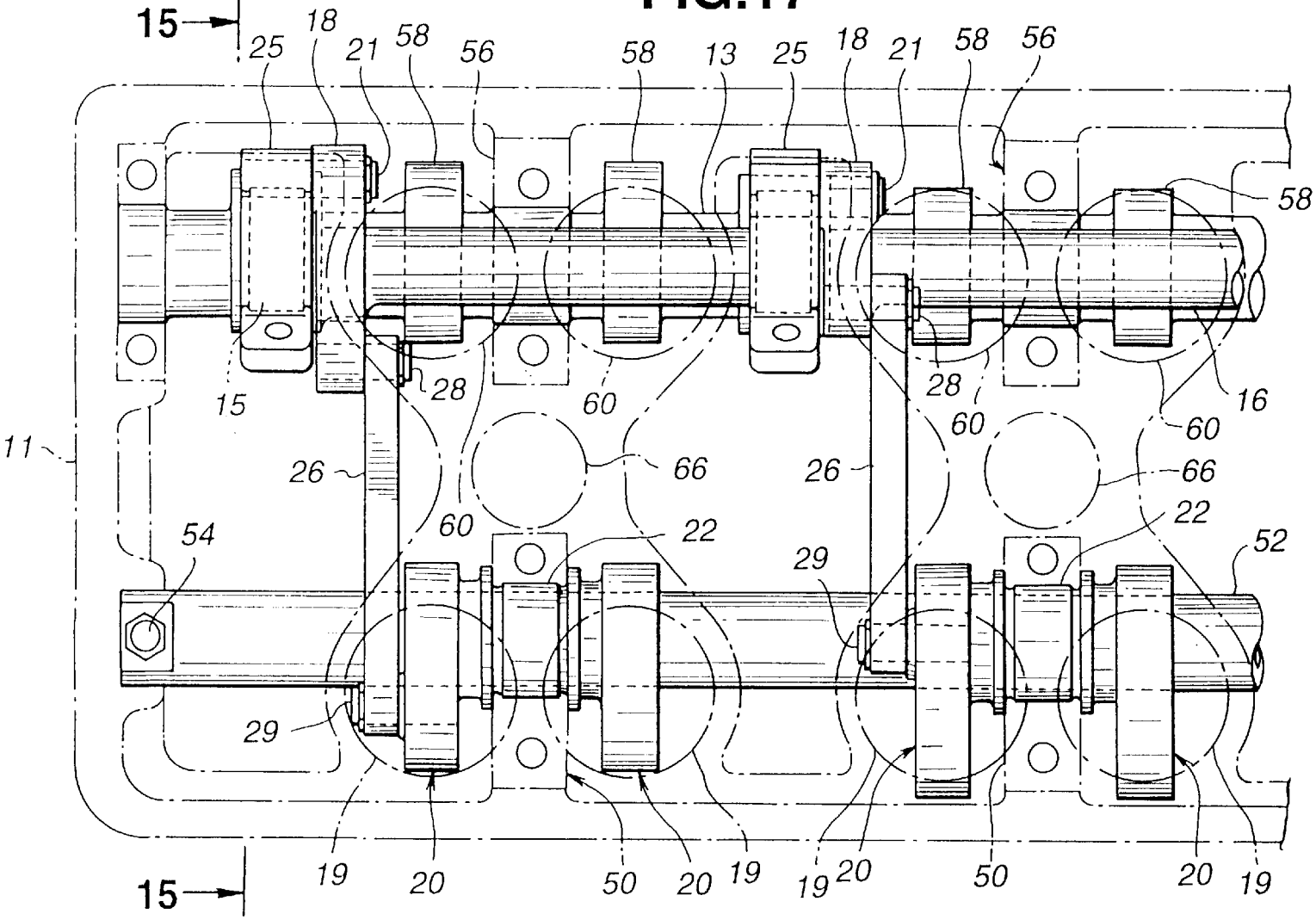
FIG. 17 is a top plan view of the VVA apparatus shown in FIG. 15 with unnecessary parts removed or shown in phantom.

FIGS. 15 to 17 illustrate the fifth embodiment of a VVA apparatus. This embodiment is substantially the same as the second embodiment shown in FIGS. 9 to 12. In the fifth embodiment, the present invention is embodied in a V-type internal combustion engine having a cylinder head 11, but it may be embodied in an ordinary in-line internal combustion engine. Specifically, the invention is embodied in controlling intake valves, only one being shown at 12 in FIG. 15

As different from the second embodiment, a train of cam bearings 50 for intake camshaft supports a stationary shaft 52. At both end portions, the stationary shaft 52 is fixed to the cylinder head 11 by fasteners, only one being shown at 54 in FIG. 17. The stationary shaft 52 supports VO cams 20 for rotation relative thereto. The VO cams 20 can pivot about an axis of the stationary shaft 52 to press valve lifters, only one being shown at 19 in FIG. 15.

A train of cam bearings 56 for exhaust camshaft supports a driving shaft 13 and a control rod 16. Each of the cam bearings 56 includes a main bracket 56*a* that holds the driving shaft 13 on the cylinder head 11. A subordinate bracket 56*b* holds the control rod 16 on the main bracket 56*a*. A pair of fasteners 56*c* fixedly secures the brackets 56*a* and 56*b* to the cylinder head 11. The driving shaft 13 has, as second VO cams, exhaust cams 58. The exhaust cams 58 are fixed to the driving shaft 13 for rotation therewith in the same manner as they are fixed to an ordinary exhaust camshaft. The second VO cams 58 can rotate with the rotation of the driving shaft 13 to press valve lifters, only one being shown at 60 in FIG. 15, of exhaust valves, only one being shown at 62 in FIG. 15.

As readily seen from FIG. 17, the driving shaft 13, which has a shaft axis, has axially spaced ER cams 15 for cylinders, respectively. The ER cams 15 are fixed to the driving shaft 13 and axially displaced from the second VO cams 58 with respect to the shaft axis.

The control rod 16 has axially spaced eccentric control cams 17 for cylinders, respectively. The eccentric control cams 17 support rocker arms 18, respectively. Each of the rocker arms 18 has a first arm 18*b* and a second arm 18*c*.

Crank arms 25 interconnect the first arms 18*b* and the adjacent ER cams 15, respectively. Links 26 interconnect the second arms 18*c* and the adjacent VO cams 20, respectively. Each of the crank arms 25 includes an annular base portion 25*a* and an integral radial extension 25*b*. For assembly of each of the crank arms 25 with one of the ER cams 15, the annular base portion 25*a* is divided into two pieces or parts that can be integrated by a pair of bolts 64.

In FIGS. 15 to 17, spark plug posts are illustrated in phantom at 66. A rocker cover 68 is attached to the cylinder head 11.

Figure 18A:
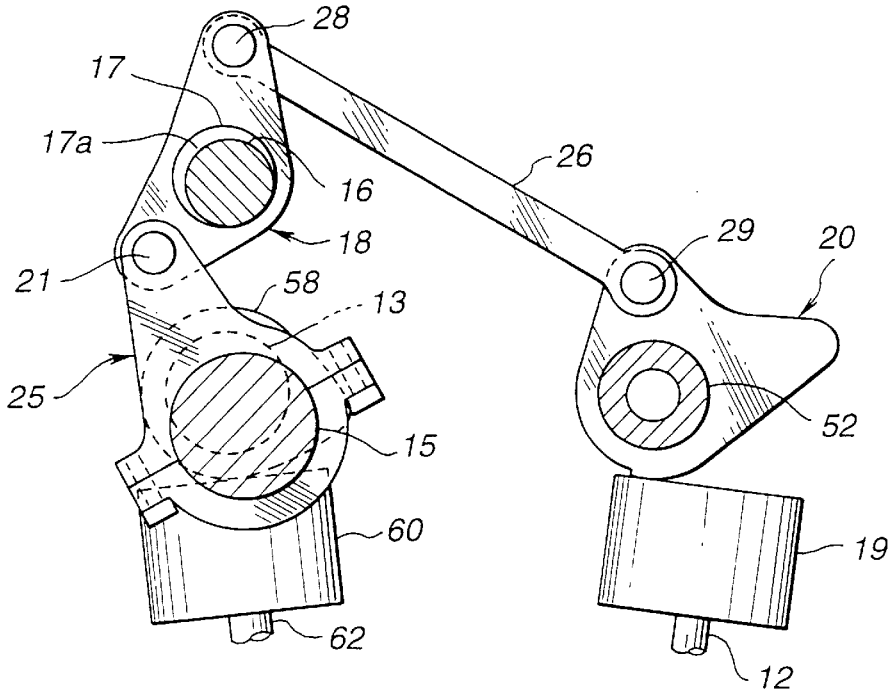
FIG. 18(A) is a cross section taken through the line 18—18 in FIG. 16, illustrating position of parts, with a control rod at a zero degree position for the first engine operation mode, to allow the associated valve lifter in its rest position.
Figure 18B:
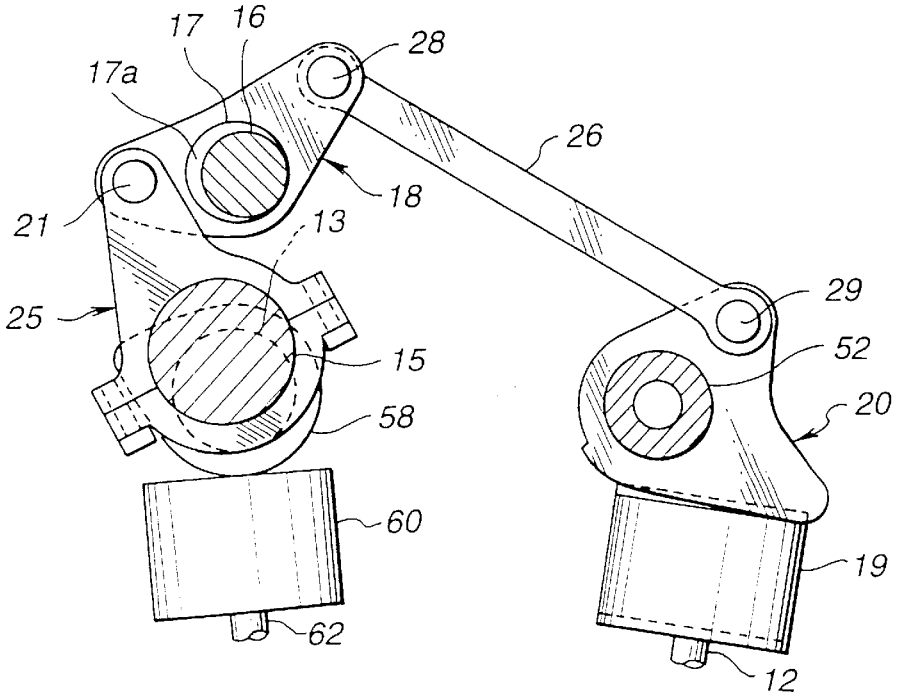
FIG. 18(B) is a similar view to FIG. 18(A) but illustrates position of parts for the first engine operation mode to lift the associated valve lifter by a maximum lift amount $L_1$.
Figure 19:
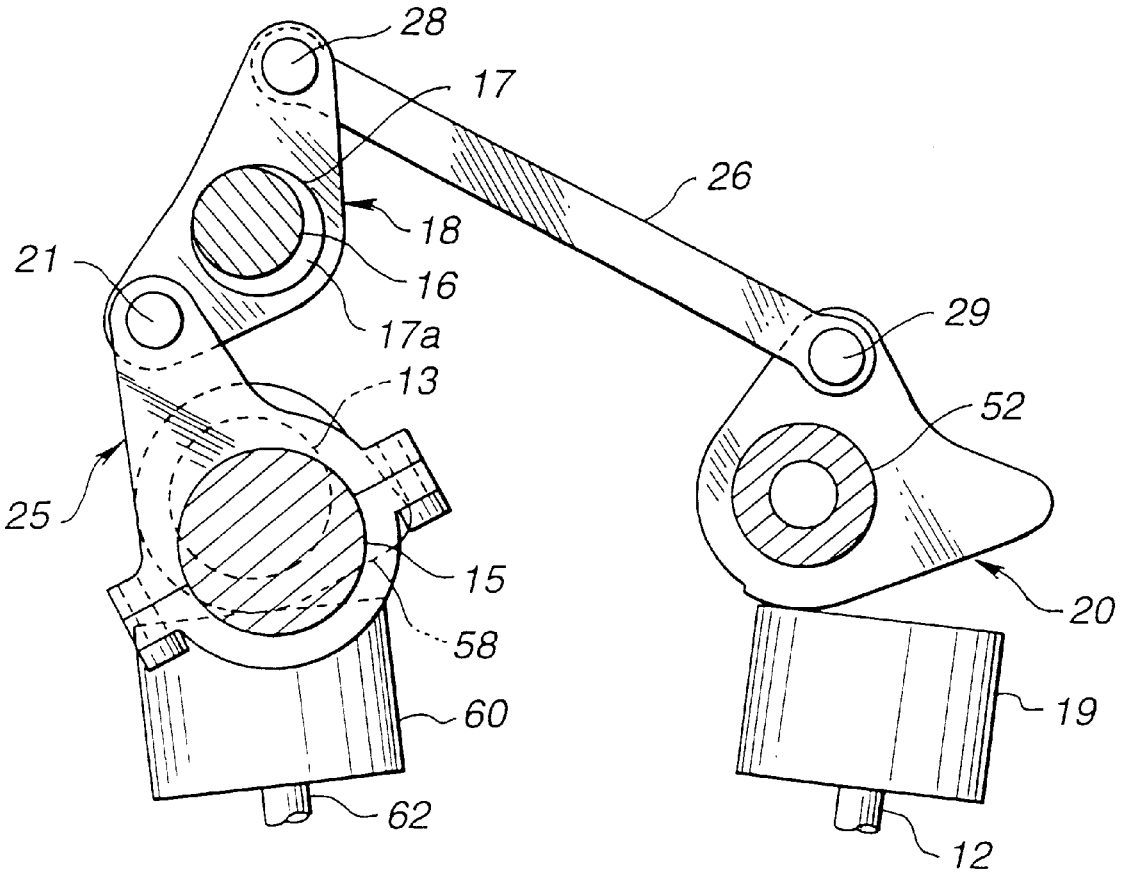
FIG. 19 is a similar view to FIG. 18(A), illustrating position of parts, with the control rod at a rotated position from the zero degree position parts for the first engine operation mode, to allow the associated valve lifter in its rest position.
Figure 20:
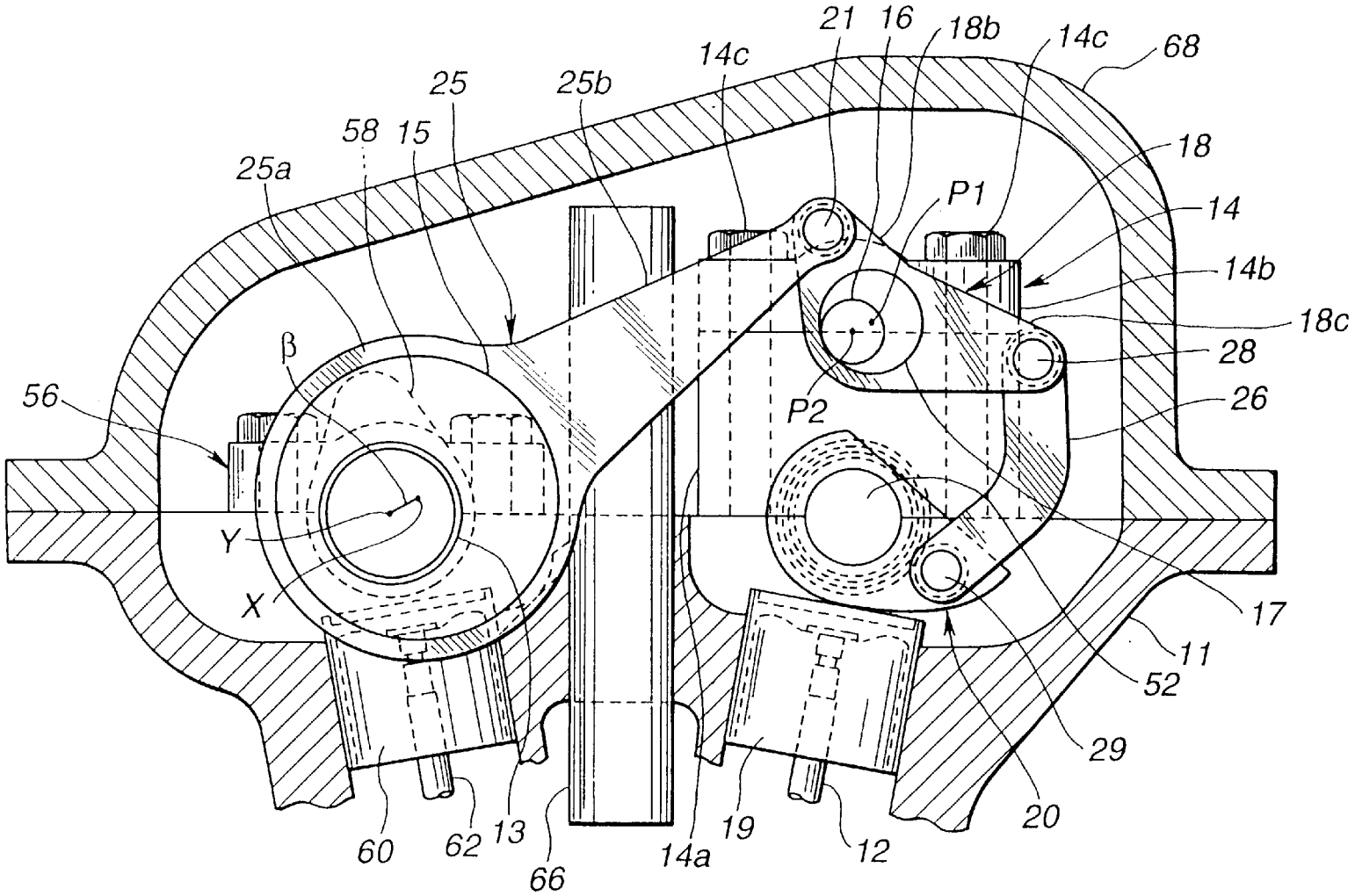
FIG. 20 is a similar view to FIG. 15, illustrating a sixth embodiment of a VVA apparatus according to the present invention.
Figure 21:
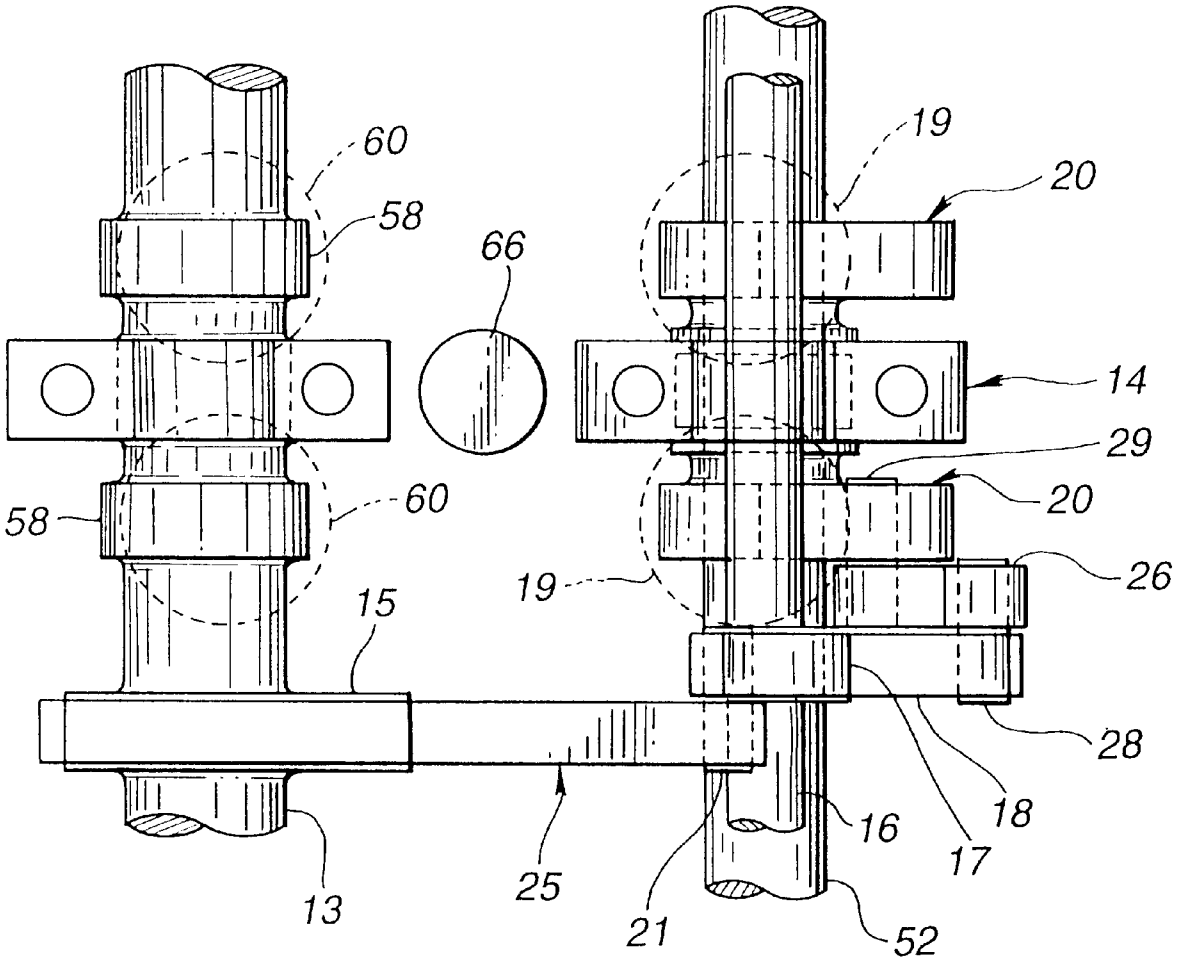
FIG. 21 is a fragmentary top plan view of the VVA apparatus shown in FIG. 20 with unnecessary parts removed.

FIGS. 18(A) and 18(B) are similar views to FIGS. 6(A) and 6(B), respectively, and show positions of parts to provide low valve lift for the first engine operation mode. FIG. 19 is a similar view to FIG. 7(A) and shows position of parts to provide high valve lift for the second engine operation mode.

The control rod 16 and the rocker 18 are arranged over the driving shaft 13 that serves as an exhaust camshaft. This arrangement is particularly fit for installation in the V-type internal combustion engine that has an accommodation space within the rocker cover 68 above the exhaust valves 62. However, this arrangement of the control rod 16 is not recommended for a transversely mounted in-line internal combustion engine. This is because there is little space available above exhaust valves that are disposed in front of intake valves within an engine compartment of an automotive vehicle.

Figure 22:
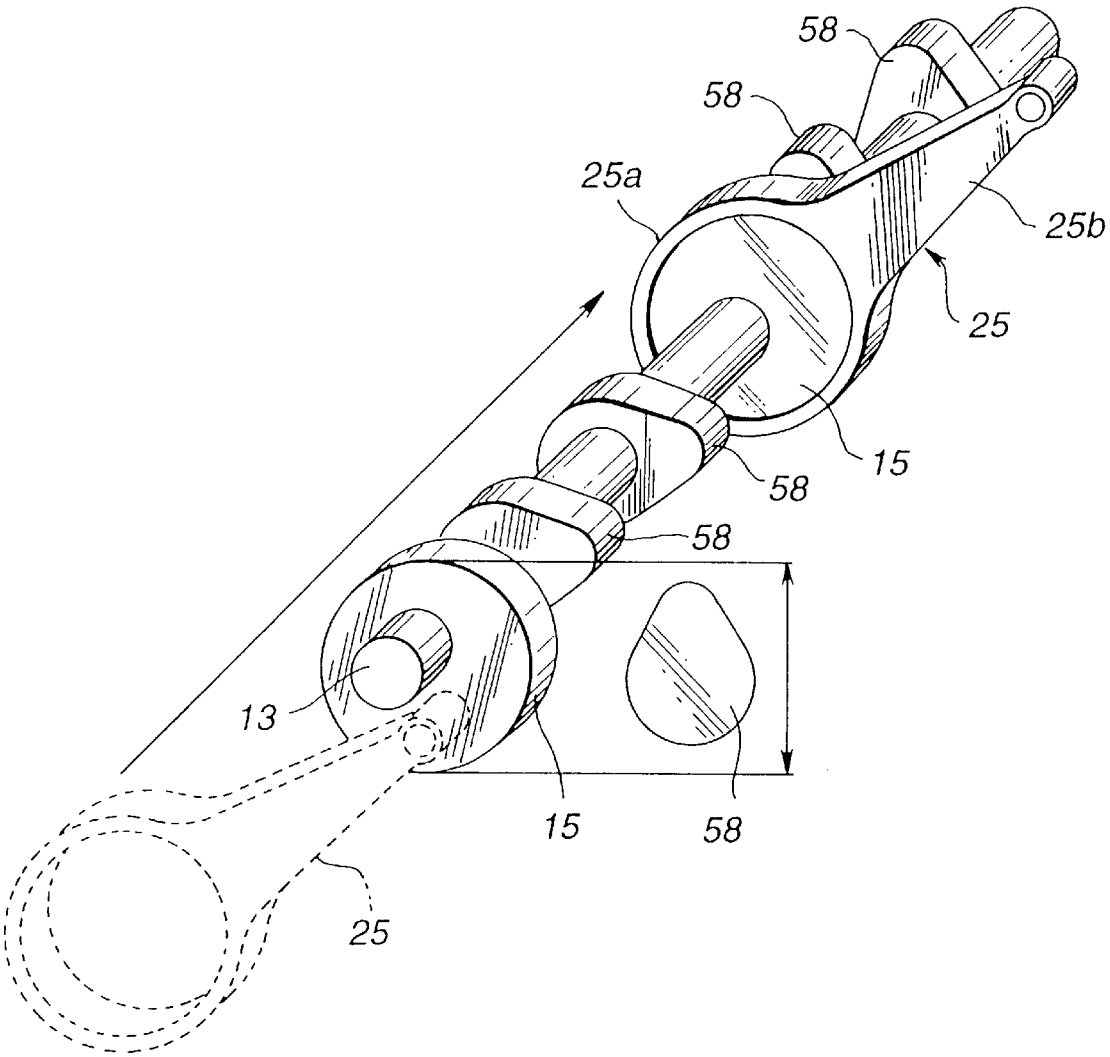
FIG. 22 is a perspective view of a driving shaft used in the sixth embodiment.

FIGS. 20 to 24 illustrate the sixth embodiment incorporating an arrangement recommendable for installation in the transversely mounted in-line internal combustion engine. This embodiment is different from the fifth embodiment shown in FIGS. 15 to 19 in that a control rod 16 and a rocker arm 18 are arranged within an area that extends over a stationary shaft 52. The manner of mounting the control rod 16 is substantially the same as that was explained in connection with FIG. 1. Another difference resides in employment of an ER cam 15 that has a sufficiently large radial extension with respect to a shaft axis Y of a driving shaft 13 for ease of assembly of crank arms 25 with the driving shaft 13. Each of the ER cams 15 has a circular periphery and has a profile wide enough to cover a profile of each of second VO cams 58 viewing the driving shaft 13 in a direction of the shaft axis Y as best seen in FIG. 22. Each crank arm 25 used in this embodiment is different from its counterpart in the fifth embodiment shown in FIGS. 15 to 19 in that its annular base portion 25*a* is an integral piece. In other words, each of the crank arms 25 is a integral piece. Referring to FIG. 22, each of the crank arms 25 may be coupled with one of the ER cams 15 only by moving the annular base portion 25*a* along the shaft axis Y of the driving shaft 13. This is because the second VO cams 58 will not interfere with such movement of the crank arm 25.

Figure 23:
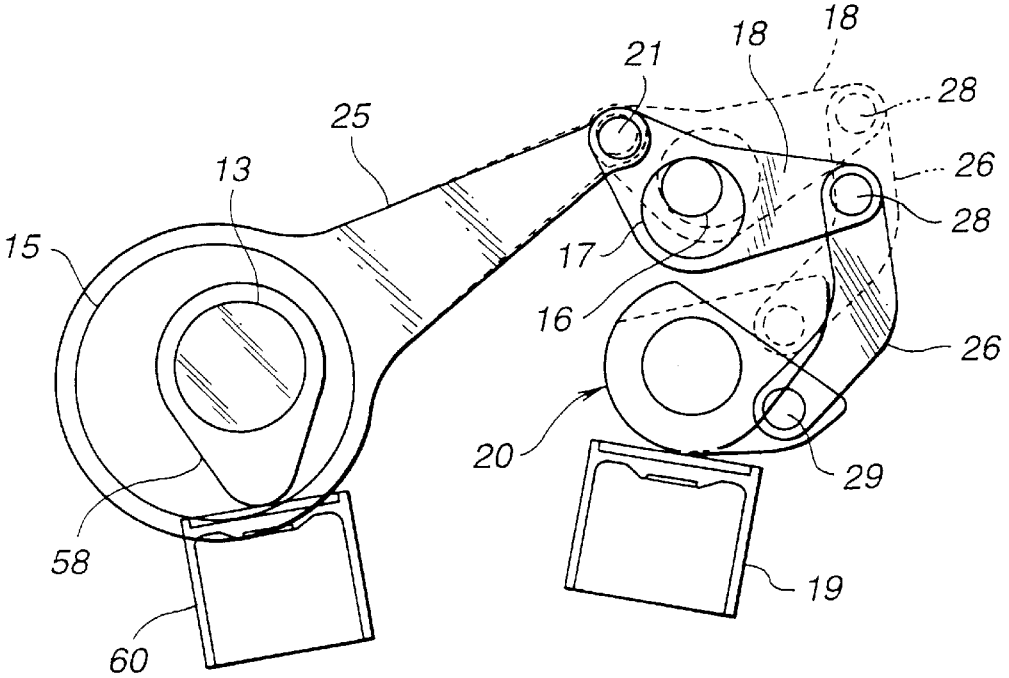
FIG. 23 illustrates, in the doted line, the position of parts of the sixth embodiment with a control rod at a zero degree position for the first engine operation mode, to allow the associated valve lifter in its rest position, and, in the fully drawn line, the position of parts with the control rod at a rotated position from the zero degree position for the second engine operation mode, to allow the associated valve lifter in its rest position.
Figure 24:
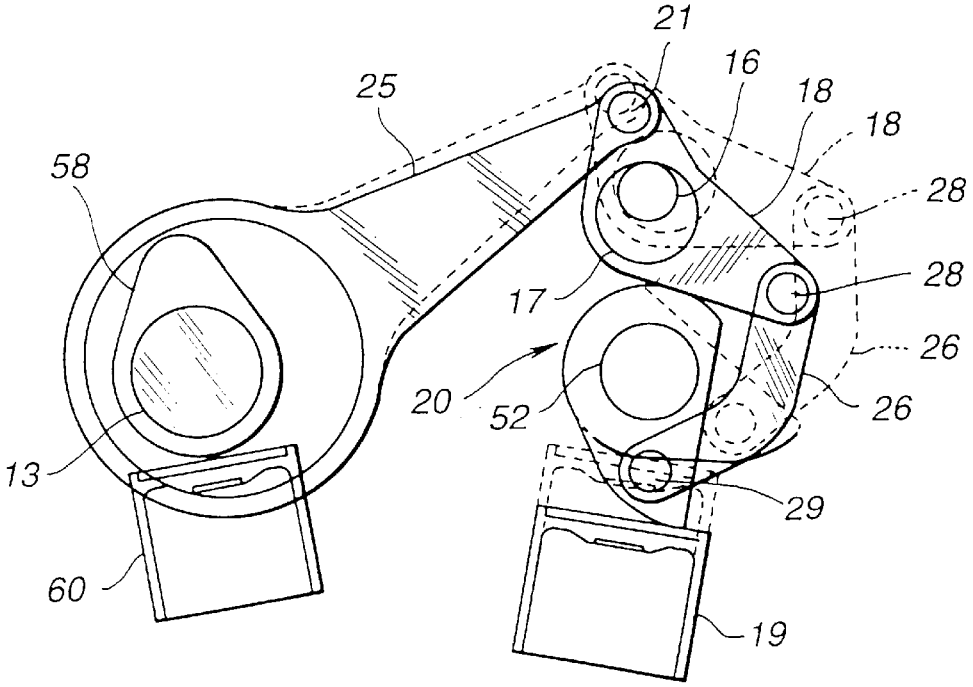
FIG. 24 illustrates, in the dotted line, the position of parts of the sixth embodiment for the first engine operation mode to lift the associated valve lifter by a maximum lift amount, and, in the fully drawn line, position of parts, with the control rod at the rotated position for the second engine operation mode, to lift the associated valve lifter by an increased maximum lift amount $L_2$.

Referring to FIGS. 23 and 24, FIG. 23 shows exhaust stroke and FIG. 24 shows intake stroke. The fully drawn line in FIG. 23 shows position of parts to provide a high valve lift for the second engine operation mode. The dotted line in FIG. 23 shows position of parts to provide a low valve lift for the first engine operation mode. The fully drawn line in FIG. 24 shows position of part for the high valve lift for the second engine operation mode. The dotted line in FIG. 24 shows position of parts to provide the low valve lift for the first engine operation mode.

Figure 25:
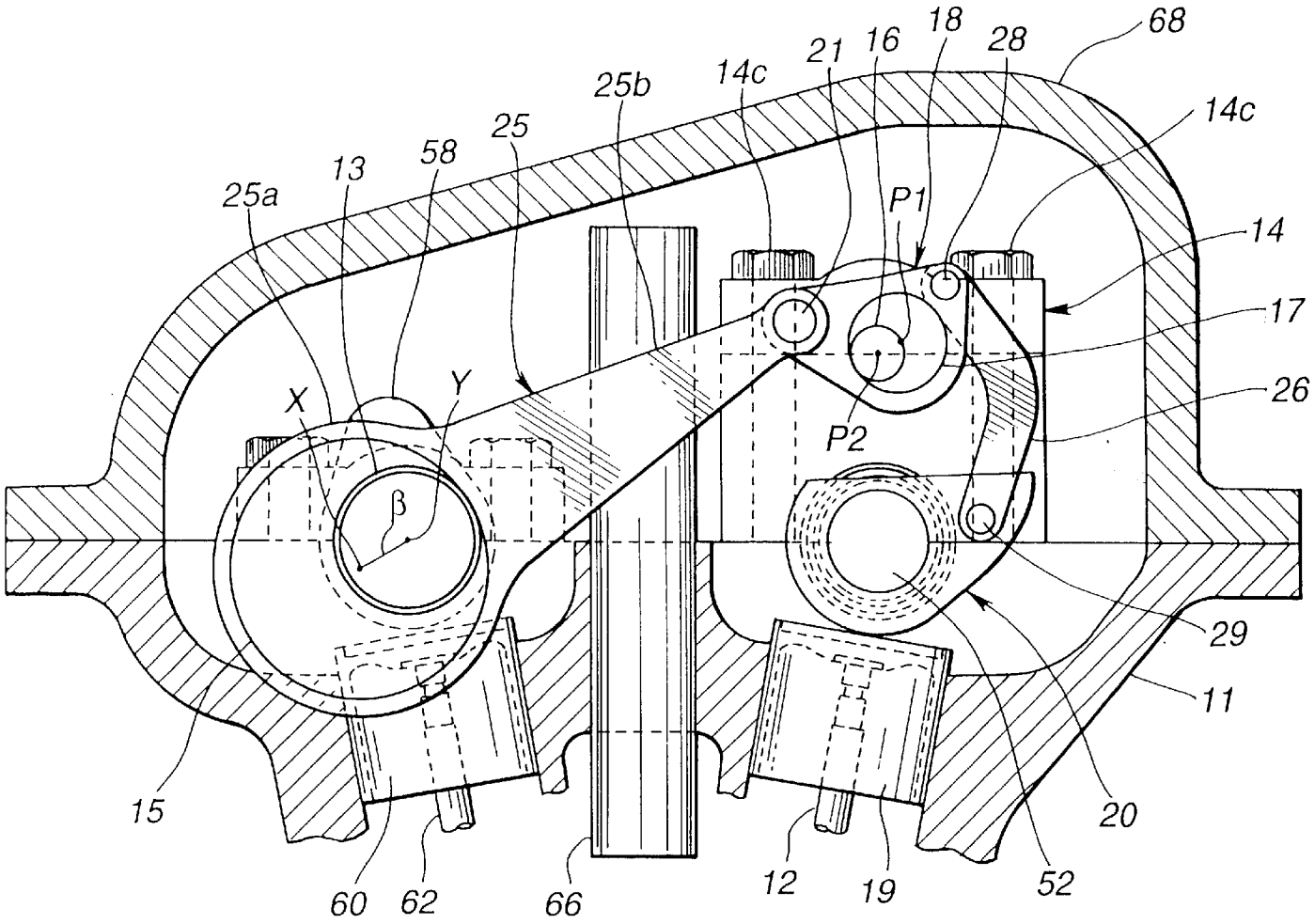
FIG. 25 is a similar view to FIG. 20, illustrating a seventh embodiment of a VVA apparatus according to the present invention.
Figure 26:
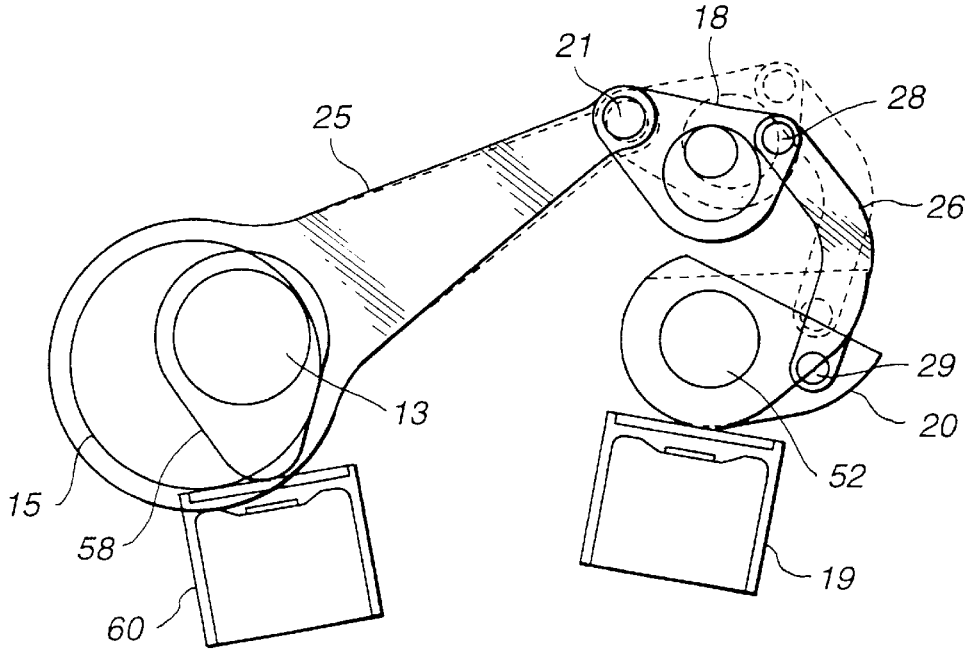
FIG. 26 illustrates, in the dotted line, the position of parts of the seventh embodiment with a control rod at a zero degree position for the first engine operation mode, to allow the associated valve lifter in its rest position, and, in the fully drawn line, the position of parts with the control rod at a rotated position from the zero degree position for the second engine operation mode, to allow the associated valve lifter in its rest position.
Figure 27:
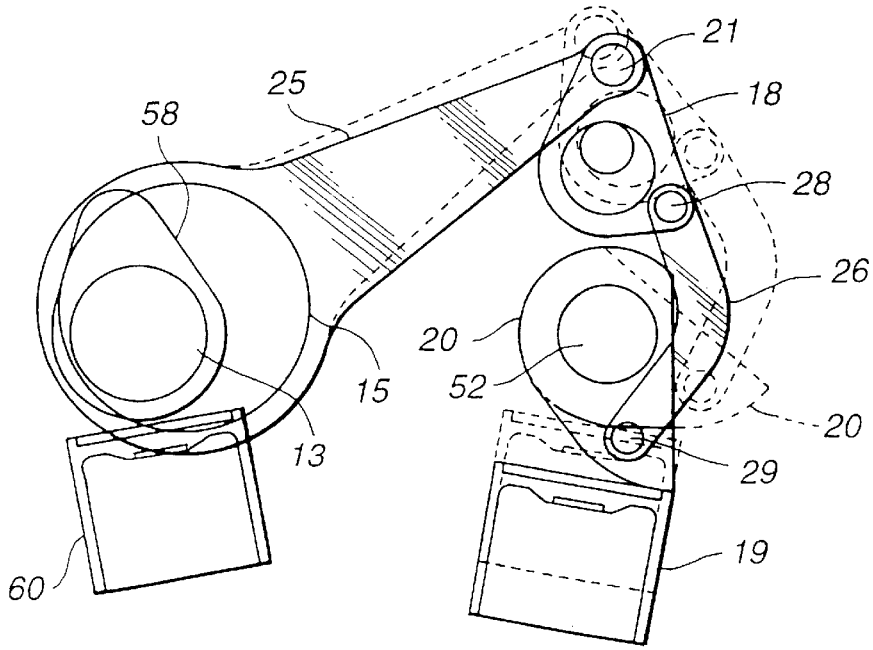
FIG. 27 illustrates, in the dotted line, the position of parts of the seventh embodiment for the first engine operation mode to lift the associated valve lifter by a maximum lift amount, and, in the fully drawn line, position of parts, with the control rod at the rotated position for the second engine operation mode, to lift the associated valve lifter by an increased maximum lift amount $L_2$.

FIGS. 25 to 27 illustrate the seventh embodiment.

Referring to FIG. 25, this embodiment is substantially the same as the sixth embodiment shown in FIGS. 20 to 24 except eccentricity β(beta) of each of ER cams 15 with respect to a shaft axis Y of a driving shaft 13. As different from the sixth embodiment, the amount of eccentricity β between the axis X of each of the ER cams 15 and the shaft axis Y is sufficiently increased to provide an increased rocker ratio D/E. D represents a distance between a pin 21 and an axis P1 and E a distance between the axis P1 and a pin 28. According to this embodiment, the amount of eccentricity β is sufficiently increased to allow the use of the rocker arm 18 that has a decreased proportion of E with respect to D to provide substantially the same valve lift characteristics as those provided by the sixth embodiment.

Referring to FIGS. 26 and 27, FIG. 26 shows exhaust stroke and FIG. 27 shows intake stroke. The fully drawn line in FIG. 26 shows position of parts to provide a high valve lift for the second engine operation mode. The dotted line in FIG. 26 shows position of parts to provide a low valve lift for the first engine operation mode. The fully drawn line in FIG. 27 shows position of part for the high valve lift for the second engine operation mode. The dotted line in FIG. 27 shows position of parts to provide the low valve lift for the first engine operation mode.

Figure 28:
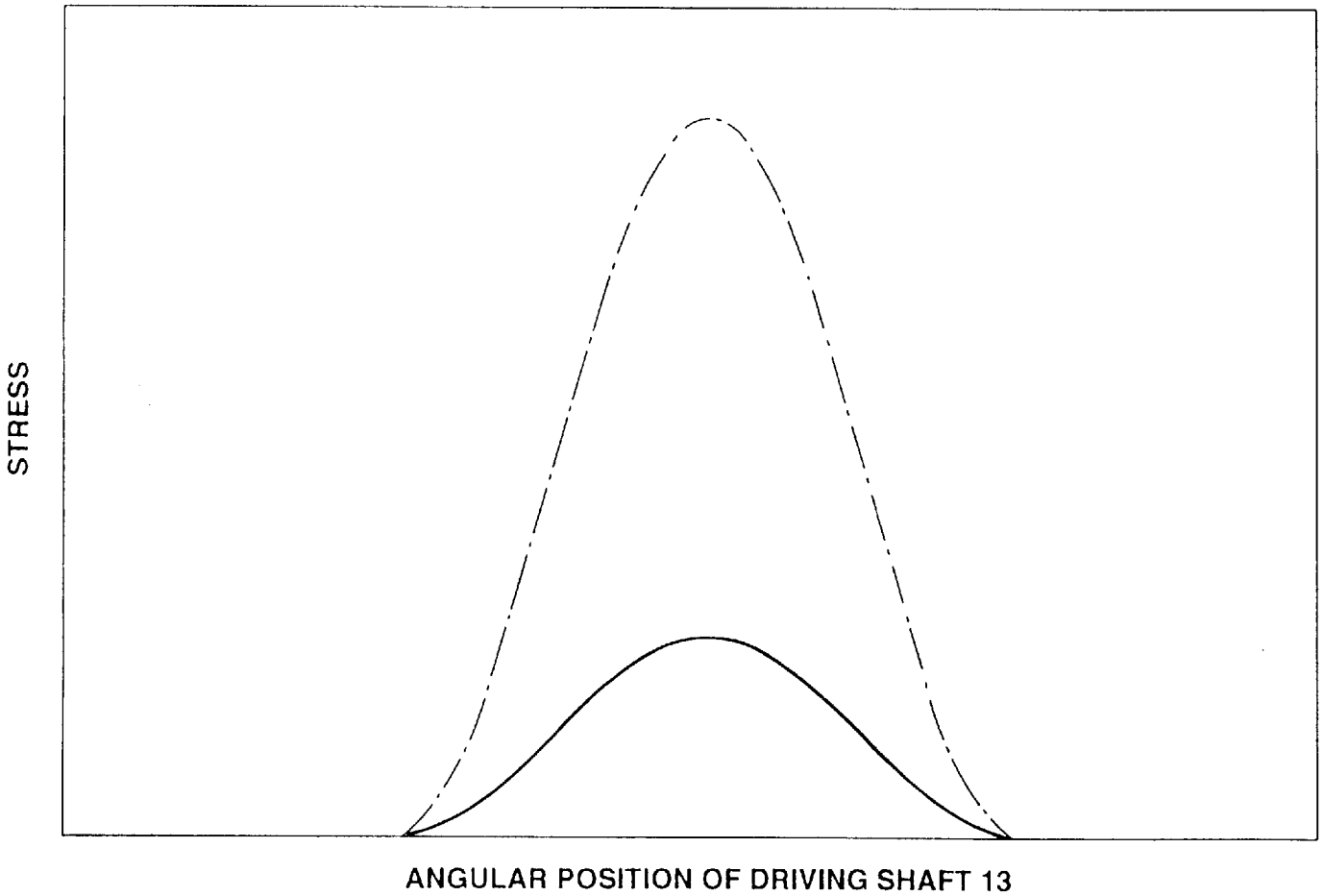
FIG. 28 graphs variation of stress applied to a crank arm of the seventh embodiment versus driving shaft angle.

FIG. 28 illustrate variation in stress applied to the crank arm 25 owing valve spring during intake stroke. Two case, namely, first and second cased, have been considered. A ratio between the eccentricity β in the first case and that in the second case is 3:5. In the first case, D:E=4:5. In the second case, D:E=5:3. One dot chain line illustrates the stress curve in the first case, while the fully drawn line illustrates the stress curve in the second case. FIG. 28 clearly shows that increasing the eccentricity β will reduce the amount of stress which the crank arm 25 is subject to. This allows the use of a thin sheet of material in forming the crank arm 25 and the ER cam 15, causing a great reduction in weight in each of the component parts of the VVA apparatus. This causes stable operation of the VVA apparatus over its operation life.

What is claimed is:

1. A variable valve actuation (VVA) apparatus for an engine having a plurality of cylinder valves, comprising:

a driving shaft;

an eccentric rotary (ER) cam fixed to said driving shaft for rotation therewith;

a pivotal valve operating (VO) cam;

a rocker arm having a first arm and a second arm, said second arm of said rocker arm being linked with said VO cam;

a control rod having an eccentric control cam, said eccentric control cam supporting said rocker arm for pivotal motion; and a crank arm interconnecting said ER cam and said first arm of said rocker arm.

2. The VVA apparatus as claimed in claim 1, further comprising a link interconnecting said second arm of said rocker arm and said VO cam to provide said driving connection of said second arm of said rocker arm with said VO cam.

3. The VVA apparatus as claimed in claim 1, wherein said driving shaft has a shaft axis and is arranged for rotation about said shaft axis, and said ER cam has a circular cam section that has a cylindrical outer peripheral surface and a center offset from said shaft axis, and wherein said crank arm is formed with a cylindrical bore that receives said circular cam section for allowing relative rotation of said crank arm to said circular section of said ER cam.

4. The VVA apparatus as claimed in claim 3, wherein said crank arm has a base portion including said cylindrical bore and an integral radial extension.

5. The VVA apparatus as claimed in claim 4, further comprising:

a pin extending through said integral radial extension and said first arm of said rocker arm to provide a motion transmitting connection therebetween.

6. The VVA apparatus as claimed in claim 5, further comprising a link interconnecting said second arm of said rocker arm and said VO cam to provide said driving connection of said second arm of said rocker arm with said VO cam.

7. The VVA apparatus as claimed in claim 6, wherein said control rod has a control rod axis and is arranged for rotation about said control rod axis, wherein said eccentric control cam is in the form of a sleeve having a sleeve axis and a thickened portion, and wherein said sleeve axis is offset from said control rod axis by a predetermined amount and said sleeve supports said rocker arm for pivotal motion about said sleeve axis.

8. The VVA apparatus as claimed in claim 1, wherein said VO cam is arranged for each of two cylinder valves provided per cylinder of the engine.

9. The VVA apparatus as claimed in claim 8, further comprising a link interconnecting said second arm of said rocker arm and said VO cam to provide said driving connection of said second arm of said rocker arm with said VO cam.

10. The VVA apparatus as claimed in claim 9, wherein said two VO cams per cylinder have different cam lobes.

11. The VVA apparatus as claimed in claim 9, wherein said ER cam is arranged for each of two cylinder valves provided per cylinder of the engine, and wherein said ER cams have different eccentricity with respect to said driving shaft axis.

12. The VVA apparatus as claimed in claim 9, wherein said ER cam is arranged for each of two cylinder valves provided per cylinder of the engine, wherein said rocker arm is arranged for each of said two VO cams provided per cylinder of the engine, and wherein said two rocker arms are in driving association with said ER cams and said VO cams, respectively.

13. The VVA apparatus as claimed in claim 9, wherein said two VO cams are integrated as a unit.

14. The VVA apparatus as claimed in claim 1, including a pin and groove connection establishing said driving connection of said second arm of said rocker arm with said VO cam.

15. The VVA apparatus as claimed in claim 14, wherein said VO cam has a pin of said pin and groove connection, and said second arm of said rocker arm of said rocker arm has a groove of said second arm of said rocker arm has a groove of said pin and groove connection.

16. The VVA apparatus as claimed in claim 15, wherein said groove receives said pin of said VO cam to allow said pin to slide relative thereto during motion of said rocker arm relative to said VO cam.

17. The VVA apparatus as claimed in claim 16, wherein said VO cam has an integral arm that carries said pin of said pin and groove connection.

18. The VVA apparatus as claimed in claim 2, wherein said link is curved to avoid interference with said driving shaft.

19. The VVA apparatus as claimed in claim 1, further comprising a stationary shaft supporting said VO cam for rotation relative thereto.

20. The VVA apparatus as claimed in claim 20, further comprising a link interconnecting said second arm of said rocker arm and said VO cam to provide said driving connection of said second arm of said rocker arm with said VO cam.

21. The VVA apparatus as claimed in claim 20, further comprising a second VO cam fixed to said driving shaft for rotation therewith.

22. The VVA apparatus as claimed in claim 21, wherein the plurality of cylinder valves include an intake valve and an exhaust valve, and wherein said first mentioned VO cam controls one of the intake and exhaust valves, and said second VO cam controls the other of the intake and exhaust valves.

23. The VVA apparatus as claimed in claim 22, further comprising a link interconnecting said second arm of said rocker arm and said first VO cam to provide said driving connection of said second arm of said rocker arm with said first VO cam.

24. The VVA apparatus as claimed in claim 23, wherein said crank arm has an annular end portion formed with a mounting opening, said mounting opening receiving said ER cam for relative rotation thereto.

25. The VVA apparatus as claimed in claim 24, wherein said driving shaft is arranged to keep said second VO cam in driving contact with the exhaust valve, and said stationary shaft is arranged to keep said first VO cam in driving contact with the intake valve.

26. The VVA apparatus as claimed in claim 25, wherein said control rod is arranged within an area that extends over said driving shaft.

27. The VVA apparatus as claimed in claim 26, wherein said annular end portion of said crank arm is dividable into two pieces for interposing therebetween said ER cam.

28. The VVA apparatus as claimed in claim 25, wherein said control rod is arranged within an area that extends over said stationary shaft.

29. The VVA apparatus as claimed in claim 28, wherein, viewing said driving shaft in a direction of said shaft axis, said ER cam has a profile wide enough to cover a profile of said second VO cam, and wherein said mounting opening of said crank arm is wide enough to allow insertion of said second VO cam with a clearance.

30. The VVA apparatus as claimed in claim 25, wherein said ER cam and said second VO cam are arranged on said driving shaft in spaced relationship along said shaft axis.

* * * * *